US005852765A

United States Patent [19]

Yamashita et al.

[11] Patent Number: 5,852,765

[45] Date of Patent: Dec. 22, 1998

[54] IMAGE FORMING SYSTEM AND FINISHER

[75] Inventors: Hiroki Yamashita, Okazaki; Tatsuya Shinno; Yoshihito Hirano, both of Toyokawa, all of Japan

[73] Assignee: Minolta Co., Ltd., Osaka, Japan

[21] Appl. No.: 718,736

[22] Filed: Sep. 18, 1996

[30] Foreign Application Priority Data

Sep. 19, 1995 [JP] Japan ..... 7-239553
Dec. 8, 1995 [JP] Japan ..... 7-320388

[51] Int. Cl.[6] ..... G03G 15/00; B65H 35/06

[52] U.S. Cl. ..... 399/407; 270/58.09; 399/410

[58] Field of Search ..... 399/407, 408, 399/410, 85; 270/4, 5.01, 20.1, 32, 37, 41, 58.08, 58.09, 58.01, 58.07; 271/184

[56] References Cited

U.S. PATENT DOCUMENTS

| | | | |
|---|---|---|---|
| 4,640,611 | 2/1987 | Ohdake et al. | 399/408 X |
| 4,763,167 | 8/1988 | Watanabe et al. | 347/155 |
| 4,917,366 | 4/1990 | Murakami et al. | 270/58.09 |
| 4,973,036 | 11/1990 | Yamashita et al. | 270/58.12 |
| 4,981,293 | 1/1991 | Yamashita et al. | 271/184 |
| 5,323,221 | 6/1994 | Tomimori et al. | 399/407 X |
| 5,442,432 | 8/1995 | Tani | 399/410 |

FOREIGN PATENT DOCUMENTS

| | | |
|---|---|---|
| 61-12573 | 1/1986 | Japan . |
| 3-143871 | 6/1991 | Japan . |
| 7-50738 | 2/1995 | Japan . |
| 7-165365 | 6/1995 | Japan . |

*Primary Examiner*—Shuk Lee
*Assistant Examiner*—Sophia S. Chen
*Attorney, Agent, or Firm*—McDermott, Will & Emery

[57] ABSTRACT

A finisher unit receives a sheet discharged from a copying machine, and in a folding/punching mode, the sheet is conducted into a longitudinal transport path. A fold/punch mechanism includes a pair of folding rollers and a punching rod. The sheet fed into the longitudinal transport path goes in contact, at its leading edge, with a nip portion between transport rollers which are in the state of rotation stop, whereupon a center portion of the sheet is bent to be threaded between the folding rollers and transported to the punching rod. When the bent portion of the sheet is transported by a given distance, the punching rod operates one vertical stroke to provide a punch hole to the sheet.

29 Claims, 39 Drawing Sheets

IMAGE FORMING SYSTEM AND FINISHER

BACKGROUND 0F THE INVENTION

1. Field of the Invention

The present invention relates to an image forming system including an image forming apparatus for electrophotographically forming an image on a sheet, and a finisher which carries out stapling/punching operations with respect to sheets discharged from the apparatus.

2. Description of Prior Art

Hitherto, various types of finishers have been known which sort image-formed sheets discharged from an electrophotographic copier or a laser printer into a desired number of sets and/or staple such sheets. Recently, the practice of sheet finishing has been further diversified, and already several proposals have been made for doubling sheets and/or forming punch holes by punching sheets. Publications teaching these techniques include Japanese Patent Laid-Open Publication No. 61-12573 (punching/sheet folding/stapling), U.S. Pat. No. 4,917,366 (sheet folding/stapling), U.S. Pat. No. 4,763,167 (punching/sheet folding/stapling) and Japanese Patent Laid-Open Publication No. 7-50738 (sheet folding/stapling).

In particular, a finisher having a sheet folding function has two finish modes, namely, a so-called center stapling mode in which a sheet or a set of sheets is folded in two, with image-formed surface positioned inner side, and a so-called double edge stapling mode in which a sheet or a set of sheets is folded in two, with the image-formed surface positioned outer side. Further, these modes are different from each other in the manner of sheet folding.

However, with prior art finishers having plural folding modes, one problem is that the sheet transport path is complicatedly branched for each folding mode, which involves greater configurational complexity, increased size, and higher costs. Complicated transport paths are liable to cause paper jamming and also involve an inconvenience that more laborious work is required to remove jammed paper.

Another problem with prior art finishers is that punching operation is carried out with plural sheets of paper laid one over another, which requires considerable punching force, thus resulting in an increased size of a punching device and high energy cost.

A further problem with prior art finishers is that when punching and/or stapling operation is selected, punching and/or stapling finish is effected with all the copy sheets; therefore, it is impracticable to effect finishing in such a manner that of a total of 5 sets of copies, for example, 3 sets are to be punched and/or stapled, with the remaining 2 sets being left unfinished.

Additionally, prior art finishers have a drawback such that once print switch is turned on, an input for execution or cancellation of punching operation cannot be made in the course of copying operation. More specifically, in case that when punching operation is required, the operator fails to so input and inadvertently turns on the print switch, all copy sets currently registered are totally accommodated in the finisher without punching finish, with the result that after the necessary copying has been completed, the operator is required to take the trouble of punching with respect to all the copies made.

SUMMARY OF THE INVENTION

Accordingly, an object of the present invention is to provide a finisher which is simple in construction and which is capable of processing copy sheets in plural sheet folding modes.

It is another object of the invention to provide a finisher which includes a punching device of simple construction and which requires less energy consumption for driving purposes.

It is a further object of the invention to provide an image forming system which is capable of performing punching and/or stapling operation with respect to any desired number of copies or sets, of the preset number of copies or sets.

It is a still further object of the invention to provide an image forming system which permits execution or cancellation of punching finish even in the course of image forming operation.

In order to accomplish the foregoing objects, a finisher in accordance with the present invention comprises mode setting means, transporting means for transporting a sheet to a next process section, a folding roller for folding the sheet in two midway of the transportation by the transporting means, and control means. With the mode setting means, a first folding mode in which the sheet is folded with its image-formed side inside and a second folding mode in which the sheet is folded with its image-formed side outside can be set. When the first folding mode is set, the control means controls the folding roller to rotate forward in the middle of the transportation of a sheet by the transporting means to fold the sheet in two with its image-formed side inside and thereafter controls the folding roller to rotate in reverse and the transporting means to transport the sheet unfolded. When the second folding mode is set, the control means controls the folding roller to rotate forward in the middle of the transportation of a sheet by the transporting means to fold the sheet in two with its image-formed side outside and thereafter controls the folding roller to rotate in reverse and the transporting means to transport the sheet kept folded. Thus, since the transporting means and the folding roller which is provided midway in the transporting means are operative in the first folding mode (center stapling mode) and in the second folding mode (double edge stapling mode), the transporting path of the finisher is simple and down-sized, and accordingly, paper jamming is unlikely to occur.

The finisher may be structured so as to set a duplex mode by the setting means in which a sheet with images on both sides is handled. In this case, it is preferred that the control means is so structured to, when the duplex mode and the second folding mode are concurrently set by the setting means, cancel the second folding mode and set the first folding mode. If a sheet with images on both sides is processed in the second folding mode, one of the images on the sheet will be inside of the folded sheet. However, if such a sheet is processed in the first folding mode, the sheet will be stitched like a magazine, and the images on both sides can be seen.

Another finisher according to the present invention comprises a folding means which folds a sheet in two while the sheet is transported, transporting means for transporting the folded sheet with the folding position as a leading edge, and punching means which is disposed adjacent to the transporting means. In the finisher, the punching means makes a punch hole in a single sheet folded in two. Therefore, the punching means needs only a light driving source, resulting in downsizing and energy-saving of the finisher. Further, by using the folding means also as the transporting means, the finisher can be more downsized. Also, if the punching means is so structured as to make a punch hole in a sheet while the sheet is held by the transporting means, the punch hole can be made in an accurate position.

An image forming system according to the present invention comprises a first input means for inputting the number of image-formed sheet sets be made, a second input means for inputting the number of sets to be subjected to punching processing and/or stapling processing, and control means for controlling the system to form images on sheets according to the number designated by the first input means and to provide the punching processing and/or the stapling processing to the image-formed sheet sets according to the number designated by the second input means. In the image forming system, the number of image-formed sheet sets to be made and the number of image-formed sheet sets to be subjected to the punching processing and/or the stapling processing can be inputted independently of each other. Therefore, image-formed sheet sets with being punched and/or stapled and image-formed sheet sets without being punched and/or stapled can be made in a continuous image forming operation.

Further, an image forming system according to the present invention comprises a first input means for inputting the number of image-formed sheet sets to be made, a second input means for inputting execution or cancellation of punching processing, and control means which, when an input is made by the second input means, controls the system to carry out or cancel the punching processing to next and succeeding image-formed sheet sets. In the image forming system, execution or cancellation of the punching processing can be accepted even during an image forming operation. Therefore, even if an operator makes a mistake in selecting a mode, a change of the mode setting in the middle of the image forming operation is possible.

BRIEF DESCRIPTION OF THE DRAWINGS

These and other objects and features of the present invention will become apparent from the following description with reference to the accompanying drawings, in which:

FIGS. 20*a*–20*l* are flow charts showing sub-routines for transport/punching/sheet folding operations by the third CPU; and FIGS. 21*a*–21*d* are flow charts showing a sub-routine for stapling operation by the third CPU.

DETAILED DESCRIPTION OF THE PREFERRED EMBODIMENTS

One embodiment of the present invention will now be described with reference to the accompanying drawings.

General Structure of the Copying System

Figure 1:
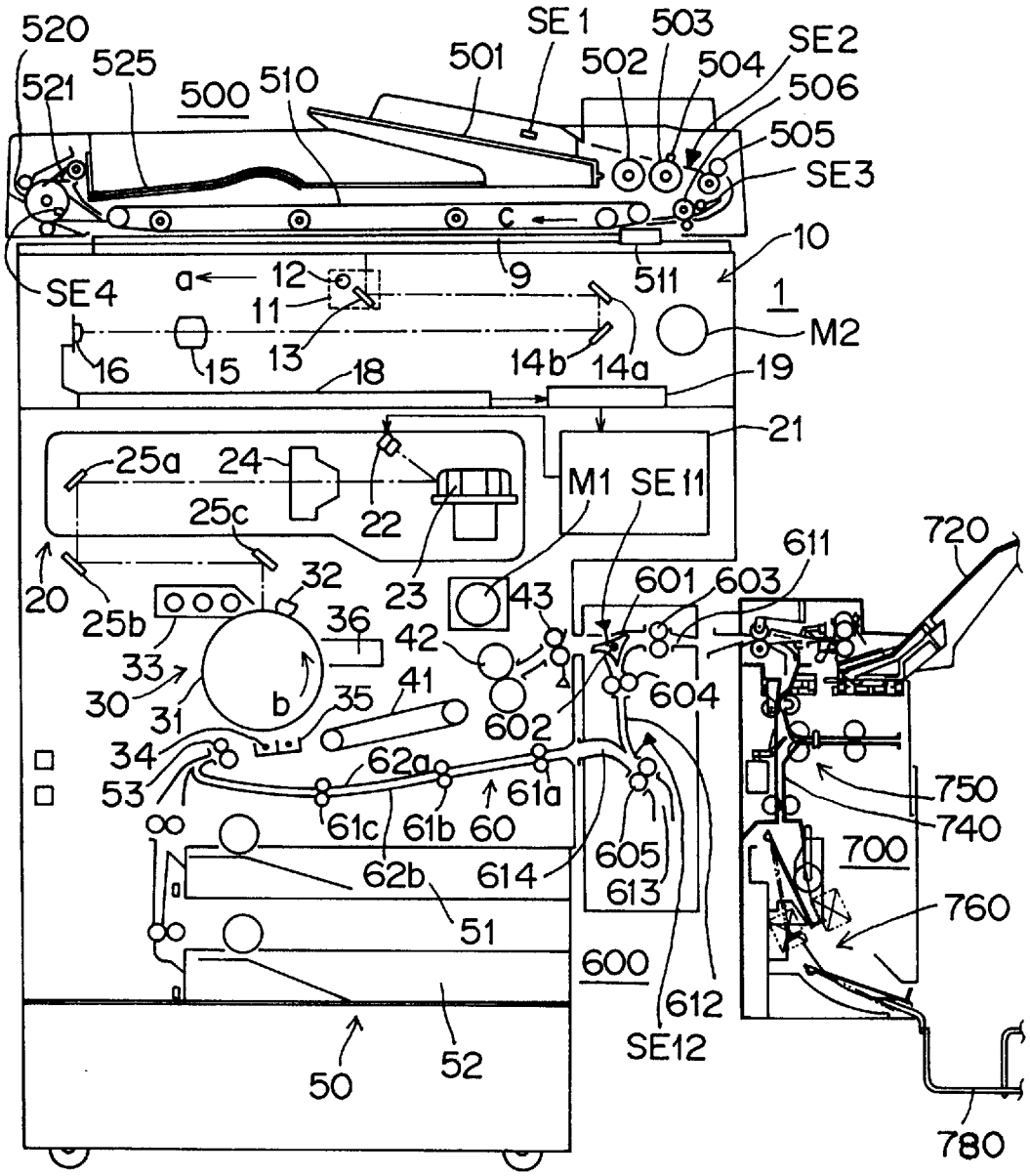
FIG. 1 is a schematic view of a copying system which is an embodiment of the present invention.

FIG. 1 illustrates an electro-photocopying system. The copying system comprises a digital copying machine 1, an automatic document feeder 500 (hereinafter referred to as ADF), a sheet inversion unit 600 connected to a discharge portion of the copying machine 1, and a finisher unit 700.

Structure and Action of the Copying Machine

The copying machine 1 includes an image reader unit 10 disposed in an upper tier portion, a laser beam scan unit 20 and an image forming section 30, both disposed in a middle tier portion, and a sheet feed section 50 disposed in a lower tier portion.

The image reader unit 10 comprises a scanner 11 for scanning the image of a document placed on a document glass 9, a line sensor 16 for reading a scanned image, an image signal processing section 18 for carrying out quantization of image signals output from the line sensor 16 and signal processing operations in accordance with various image forming modes, and a memory unit 19 for storing image data. The scanner 11 comprises a document illuminating lamp 12, a mirror 13, a scan motor M2 for moving the lamp 12 and the mirror 13 in the direction of arrow a, mirrors 14*a*, 14*b*, and a converging lens 15. Illuminating light from the lamp 12 is reflected by the surface of a document to become incident on the line sensor 16 through mirrors 13, 14*a*, 14*b* and lens 15.

The laser beam scan unit 20 actuates a print signal processing section 21 to modulate a laser diode 22 for light emission so that an electrostatic latent image is formed on a photosensitive drum 31 of the image forming section 30. The print signal processing section 21 carries out necessary processing with respect to image data transmitted from the memory unit 19 to produce print data and actuate the laser diode 22. A laser beam radiated from the laser diode 22 is deflected by a polygon mirror 23 to illuminate the surface of the photosensitive drum 31 through an fθ lens 24, and mirrors 25*a*, 25*b*, 25*c*.

The image forming section 30 includes a photosensitive drum 31 capable of being driven to rotate in the direction of arrow b, with a static charger 32, a developing device 33, a transfer charger 34, a sheet separation charger 35, a toner residue cleaner 36, etc. arranged around the drum 31. The process of image forming by the image forming section 30 is well known, and therefore, description of such process is omitted.

The sheet feed section 50 comprises automatic feed cassettes 51, 52 and a refeed unit 60. A sheet, fed from one of the cassettes 51, 52, is transported upward to timing rollers 53. At the timing rollers 53, the sheet is halted once and is then delivered to a transfer section in synchronism with an image formed on the photosensitive drum 31. After image transfer, the sheet is transported by a conveyor belt 41 to a fixing device 42, where toner fixing is effected. Then, the sheet is delivered into the sheet inversion unit 600 through discharge rollers 43 with the image-formed side (first side) facing up.

The refeed unit 60 is constructed as a sheet transport path consisting essentially of transport rollers 61*a*, 61*b*, 61*c*, and upper and lower guide plates 62*a*, 62*b*. Into this refeed unit 60, a sheet which has been turned over in the sheet inversion unit 600 as will be described later is delivered with the image-formed side (first side) facing up. The sheet is transported to left in FIG. 1 by the transport rollers 61*a*, 61*b*, 61*c* to the timing rollers 53. Then, the sheet is again fed to the transfer section, and an image is formed on a second side of the sheet.

Further, in the image forming section 30 there is disposed a main motor M1 for actuating the photosensitive drum 31 and the associated sheet transport system into movement.

Structure and Action of the ADF

The ADF 500 operates to feed/transport documents set on a document stacker 501 onto the document glass 9 one by one and discharge the documents onto a tray 525 after individual document images have been read by the image reader unit 10. For supply of documents from the stacker 501, the ADF 500 includes a feed roller 502, a separating roller 503 provided with a separating pad 504, an intermediate roller 505, and a resist roller 506. Documents are set in the document stacker 501 with a first page facing up, and are fed by the feed roller 502 beginning with a lowermost (ending page) document for sequential delivery onto the document glass 9 through the rollers 505, 506. At a location opposite to the upper surface of the document glass 9 there is installed a conveyor belt 510 rotatable in forward and reverse directions. When the belt 510 is driven forward in the direction of arrow c, each document delivered from the resist roller 506 is set in position on the document glass 9 relative to a document scale 511.

At a left side of the ADF 500 in FIG. 1 there is mounted a document discharge/inversion roller 520 equipped with a pawl member 521. In a case of a single-sided document (a document bearing an image only on its one side), upon completion of image reading, the conveyor belt 510 is driven forward in the direction of arrow c, and the single-sided document is transported around the discharge/inversion roller 520 and discharged onto a tray 525 with the image bearing side facing up, guided by the upper surface of the pawl member 521. Such a form of document transport is hereinafter referred to as single-sided document mode.

In a case of a double-sided document (a document bearing images on both sides), when it is fed from the resist roller 506 onto the document glass 9, the double-sided document is caused to pass over the document glass 9 and turn around the discharge/inversion roller 520 one time to be turned over. In this case, the pawl member 521 is pivoted slightly upward to enable the document to be guided by the lower side of the member 521. The conveyor belt 510 is driven in reverse for run in a direction opposite to the direction of arrow c, thereby transporting the inverted document until the leading edge of the document comes into contact with the document scale 511. At this time, image reading is carried out with respect to the back side of the document, and upon completion of reading, the double-sided document is turned around the discharge/inversion roller 520 again to assume an inverted position. At this time, the document is set on the document glass 9 with the front side facing down, whereupon image reading is carried out with respect to the front side of the document. Upon completion of the reading operation, the double-sided document is discharged, with the front side facing up, onto the tray 525 through the discharge/inversion roller 520. In this moment, the pawl member 521 returns to the position shown in FIG. 1 to guide the document by its upper surface onto the tray 525. Such form of document transport is hereinafter referred to as double-sided document mode.

Thus, the use of ADF 500 means that image reading is made beginning with a last document page, whichever the document may be single-sided or double-sided.

Further, in the ADF 500 there are provided a sensor SE1 for sensing the presence or non-presence of a document on the document stacker 501, a sensor SE2 for sensing the size of a document, a sensor SE3 for sensing a document fed, and a sensor SE4 for sensing a document sent to the discharge section. Also, in the ADF 500 there are disposed a feed motor (not shown) for driving the feed roller 502, the separating roller 503 and the intermediate roller 505, and a transport motor (not shown) for driving the resist roller 506, the conveyor belt 510 and the discharge/inversion roller 520.

Structure and Action of the Sheet Inversion Unit

The sheet inversion unit 600 has a function to deliver a sheet discharged from the discharge rollers 43 of the copying machine 1 to the finisher unit 700 and a function to deliver the sheet to the refeed unit 60. The sheet inversion unit 600 comprises a path changeover pawl 601, transport rollers 603, reversible transport rollers 604, 605, and transport paths 611, 612, 613, 614 comprised of guide plates, and also has sensors SE11, SE12 disposed therein for sensing sheets. The changeover pawl 601 is pivotable about a support shaft 602 for changeover between a position shown by solid line in FIG. 1 and a position pivoted clockwise slightly therefrom.

In a case of ordinary sheet feeding, a sheet discharged from discharge rollers 43 is guided by the upper surface of the changeover pawl 601 for delivery into the transport path 611, and is then transported from the transport rollers 603 into the finisher unit 700.

In a case where a sheet is inverted and delivered into the finisher unit 700, the changeover pawl 601 is set at a position slightly pivoted clockwise from the position shown in FIG. 1. A sheet discharged from the discharge rollers 43 is first guided by the left side of the changeover pawl 601 for being fed into the transport path 612. At this time, the transport rollers 604, 605 are in forward rotation so that the sheet is transported from the transport path 612 into the transport path 613. The time to be taken after the leading edge of the sheet is detected by the sensor SE12 until the trailing edge of the sheet passes through the changeover pawl 601 is determined from the relationship between the sheet size and the transport velocity, and upon lapse of that time, the transport rollers 604, 605 are switched over to a reverse run. Thereby, the sheet is switched back and guided by the right side of the changeover pawl 601 for transfer to the transport path 611. In this way, the sheet is turned over and is delivered from the transport rollers 603 to the finisher unit 700.

In a case where a sheet is fed into the refeed unit 60 for double side copying, the sheet discharged from the discharge rollers 43 is transferred to the transport paths 612, 613 in the same manner as in the case of above described inversion mode operation. In this case, however, when the trailing edge of the sheet is sensed by the sensor SE12, the transport rollers 605 are switched over to a reverse run. As a result, the sheet is switched back and is delivered to the refeed unit 60 with its surface turned over,.

Structure and Action of the Finisher Unit

Next, the finisher unit 700 will be explained with reference to FIGS. 2, 3 and 4.

The finisher unit 700 generally comprises rollers 701, 702 for receiving sheets, a changeover pawl 703 for transport path changeover, a discharge tray 720, a shift block 721 for shifting the discharge tray 720 a certain distance in a direction perpendicular to the direction of sheet discharge in order to sort sheets lot by lot, a longitudinal transport path 740, a fold/punch mechanism 750 provided midway in the longitudinal transport path 740, a staple tray 760 having a staple mechanism, and a stacker 780.

Sheet Ejection to the Discharge Tray

A sheet receiving section of the finisher unit 700 comprises a driving roller 701 and a driven roller 702, and guide plates 705, 706 opposed to the transport rollers 603 of the sheet inversion unit 600. Around the changeover pawl 703 there are disposed guide plates 711, 712, 713, and a sensor SE21 for sheet detection. The changeover pawl 703 has a bill-like shape and is pivotable about a support shaft 704 such that it moves from a solid line position to a dot line position in FIG. 2 when a solenoid not shown is turned on. When it is at the solid line position, the changeover pawl 703, on its upper surface, guides a sheet toward the discharge tray 720. When switched to the dot line position, the changeover pawl 703, on its lower side (curved surface), guides the sheet for entry into the longitudinal transport path 740.

Discharging sheets onto the discharge tray 720 is effected by causing each sheet to be held and carried between a set of discharge rollers 715 driven for rotation in the direction of arrow e and a set of freely rotatable balls 708. Sheets discharged on the discharge tray 720 are aligned in order by means of paddles 716 mounted in coaxial relation to the discharge rollers 715. Each of the paddles 716 is comprised of radially extending flexible vane members and is operative to apply a biasing force through its rotation in the direction of arrow e to a trailing edge portion of each sheet discharged onto the discharge tray 720 in a direction opposite to the direction of sheet discharge, whereby trailing edges of individual sheets are brought in abutment against a stationary back plate 722 for alignment.

In the present embodiment of the invention, the discharge tray 720 is shifted at specified time intervals for sorting of sheets. For this purpose, it is necessary that paddles 716 which are normally in contact with trailing edge portions of discharged sheets be shifted in association with each such shifting operation so as not to disturb sheet alignment. Therefore, the paddles 716 and the discharge rollers 715 are adapted to be integrally shiftable. Specifically, paddles 716 and discharge rollers 715 are fixedly mounted on a pipe-like shaft 717 which is loosely fitted on a support shaft 718 mounted rotatably to a frame not shown. The support shaft 718 is adapted to be driven by an unillustrated transport motor for rotation in the direction of arrow e, and has a groove portion 718*a* which is engaged by projections (not shown) formed internally of ring-shaped stoppers 719 fixed to opposite ends of the shaft 717. Therefore, the paddles 716 and the discharge rollers 715 can be integrally driven for rotation in the direction of arrow e and are integrally shiftable in the direction of arrow f. This shifting operation is carried out in conjunction with the process of stoppers 719 engaging notches 713*a* of a lower guide plate 713 to enable the lower guide plate 713 to shift along with a shift block 721 in the direction of arrow f as will be hereinafter described. The discharge rollers 715 and paddles 716 are respectively positioned in corresponding notches 713*b* and 713*c*.

The rotation of the paddles 716 is stopped when the paddles 716 make shifting in association with the shifting operation of the discharge tray 720. The reason for this is that if paddles 716 are being driven in rotation in the direction of arrow e during such shift operation, a topmost sheet is pressed against the stationary back plate 722 under the biasing force of the paddles 716 to the extent that the topmost sheet only remains unshifted, with the result that sheet alignment on the tray is disturbed. That is, it is intended that such disturbance be prevented. Stopping the rotation of paddles 716 is done by stopping the run of the transport motor.

Each ball 708 rotatably abuts against the corresponding discharge roller 715 by gravity. More specifically, each of the balls 708 is positioned in a corresponding opening 711*a* formed in an upper guide plate 711, and is retained therein as prevented from movement by a holder 709 fixed to a projection 711*b* extending upward from one edge of the opening 711*a*. Each ball 708, positioned in the corresponding holder 709, follows the rotation and shift of the corresponding discharge roller 715. Thus, the balls 708 hold a sheet in cooperation with the discharge rollers 715 to deliver the sheet onto the discharge tray 720.

Shift Block

Figure 3:
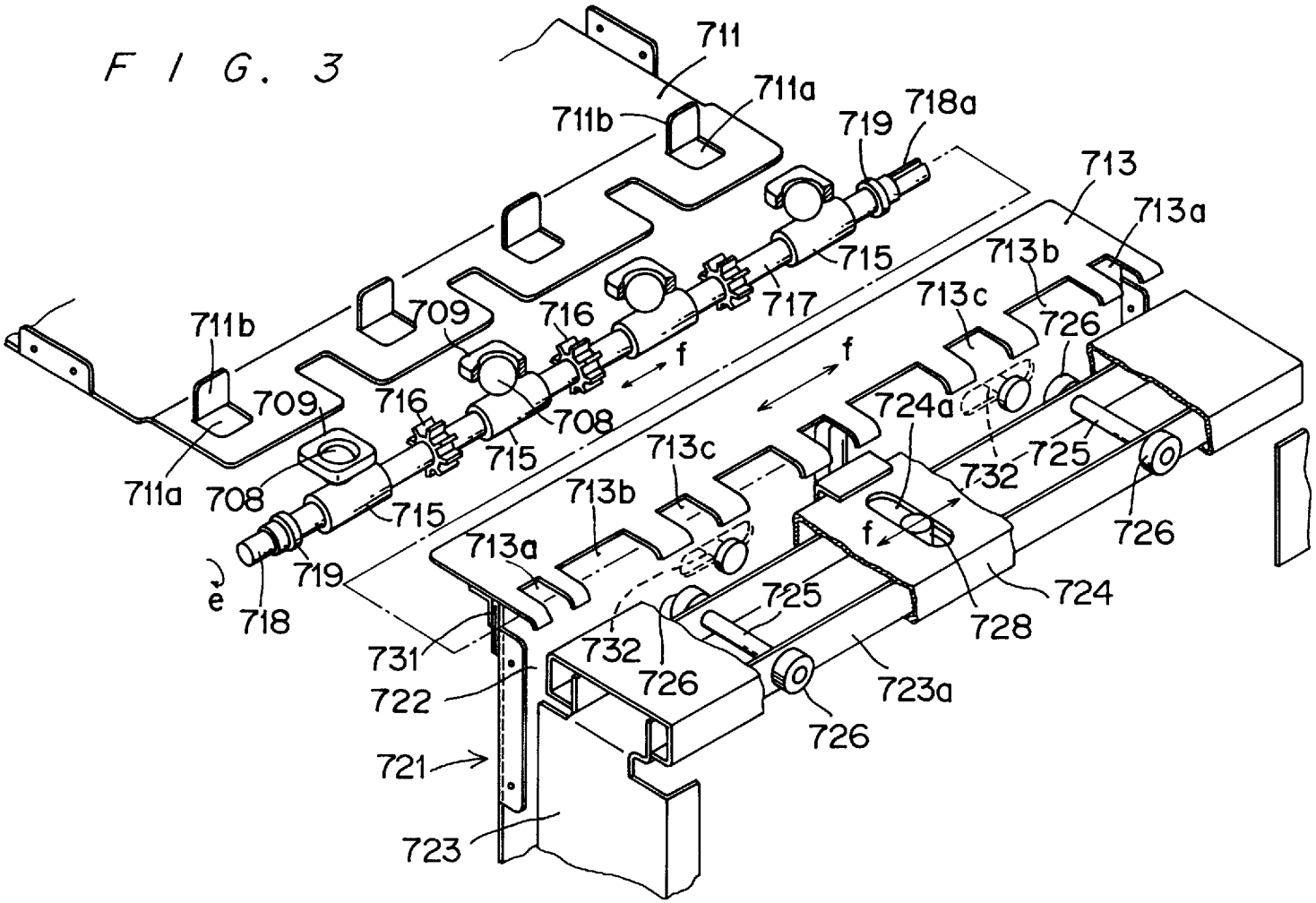
FIG. 3 is an exploded perspective view showing a sheet discharge/shift mechanism of the finisher unit.
Figure 4:
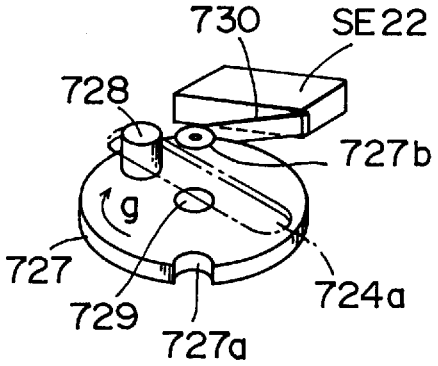
FIG. 4 is a perspective view of a shift cam of the shift mechanism and a sensor for detecting a turn of the cam.

The discharge tray 720 is attached to a shift frame 724 as shown in FIG. 3. The shift frame 724 is shiftable in the direction of arrow f by being guided by guide rollers 726 which are rotatably supported on support shafts 725 in a horizontal guide portion 723*a* of a stationary frame 723. In the horizontal guide portion 723*a* there is provided a cam 727 shown in FIG. 4, with a pin 728 fixed to the upper surface of the cam 727 at a location adjacent to the edge thereof which is in engagement with an elongate slot 724*a* of the shift frame 724. The cam 727 is adapted to be driven by a shift motor not shown for rotation about a support shaft 729 in the direction of arrow g, and has recessed portions 727*a*, 727*b* formed on its outer periphery at symmetrically angular positions of 180°. An actuator 730 for a sensor SE22 abuts the outer periphery of the cam 727 so that the sensor SE22 operates each time the actuator 730 falls into the recessed portion 727*a* or 727*b* on the basis of the rotation of the cam 727.

According to the above described arrangement, when one cycle of printing operation of the copying machine 1 completes, that is, when a last sheet of the one cycle is received onto the discharge tray 720, the shift motor is actuated so that the cam 727 is driven into rotation in the direction of arrow g. Then, when the actuator 730 falls into the next recess 727*a* or 727*b*, the shift motor is turned off. In this way, the cam 727 periodically rotates 180° each time a predetermined number of sheets is received on the discharge tray 720, so that the shift frame 724, along with the discharge tray 720, repeats reciprocal movement via pin 728 in the direction of arrow f, or in a direction perpendicular to the direction of sheet discharge.

The lower guide plate 713 is connected with the shift frame 724 through a frame 731 and a pin 732. Therefore, the lower guide plate 713, discharge rollers 715 and paddles 716 are shiftable in the direction of arrow f in interlocked relation with the shift frame 724.

Fold/Punch Mechanism

Figure 2:
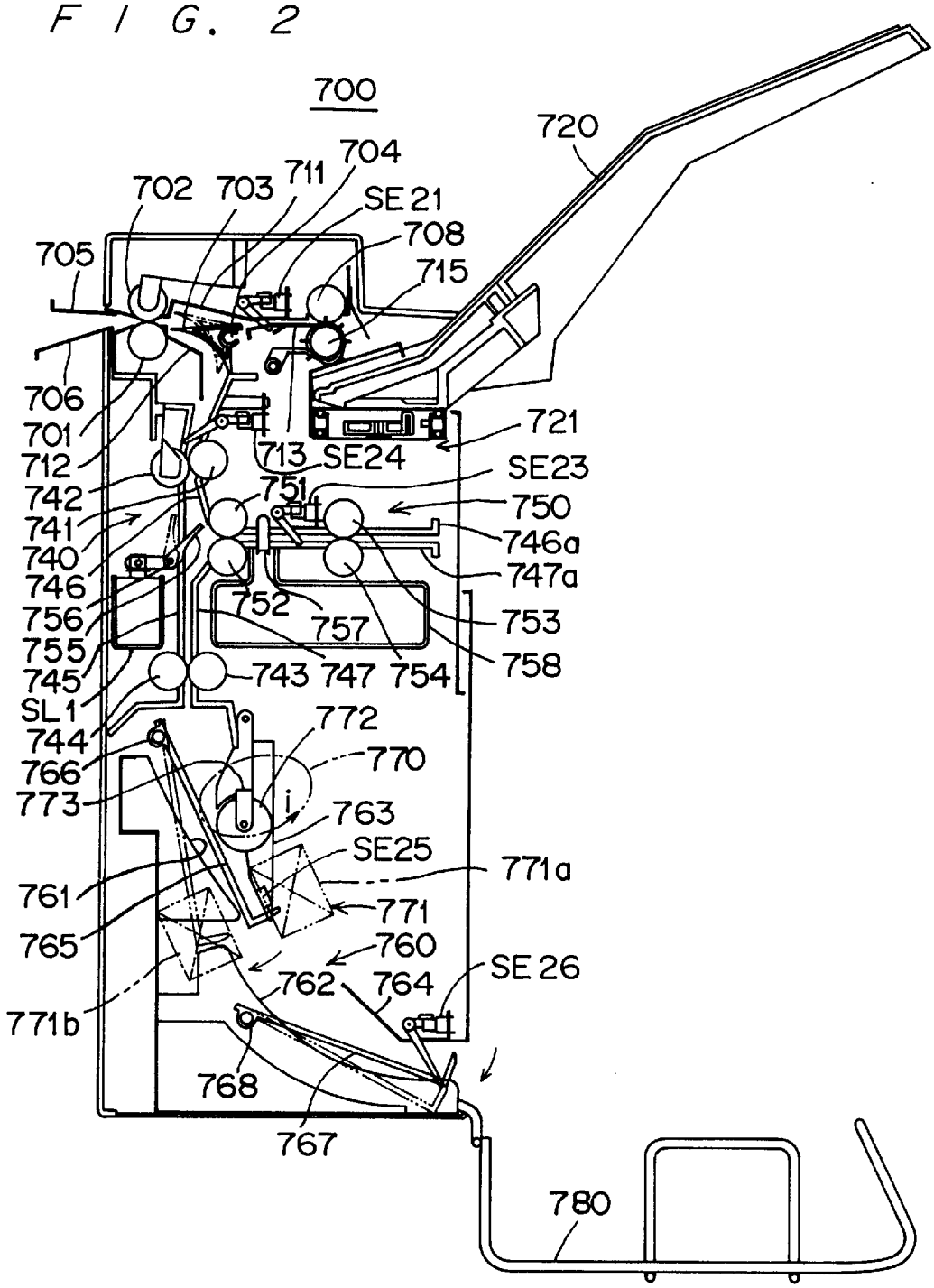
FIG. 2 is an internal schematic view showing a finisher unit as a component unit of the copying system.

As FIG. 2 shows, the longitudinal transport path 740 comprises transport rollers 741, 742, 743, 744, and guide plates 745, 746, 747. The fold/punch mechanism 750 is disposed midway in the longitudinal transport path 740, and comprises reversibly rotatable sheet folding rollers 751, 752, reversibly rotatable transport rollers 753, 754, a punching rod 757, and a punch waste container 758. Portions 746*a*, 747*a* of the guide plates 746, 747 extend horizontally rightward beyond the rollers 753, 754. A sensor SE23 for detecting sheets is disposed adjacent to the punching rod 757, and also a sensor SE24 for detecting sheets is provided in the longitudinal transport path 740.

Further, in the longitudinal transport path 740 there is provided a changeover pawl 755 in opposed relation to the sheet folding rollers 751, 752. The changeover pawl 755 is pivotable about a support shaft 756 and is connected to a solenoid SL1. When the solenoid SL1 is off, the changeover pawl 755 is at the dotted line position in FIG. 2, being held away from the longitudinal transport path 740. When the solenoid SL1 is turned on, the changeover pawl 755 is set at the solid line position for entry into the longitudinal transport path 740 in which it is positioned opposite to the sheet folding rollers 751, 752.

Operation of the fold/punch mechanism 750, that is, the center stapling/punching mode and the doubling/punching mode will now be explained.

Figure 5A:
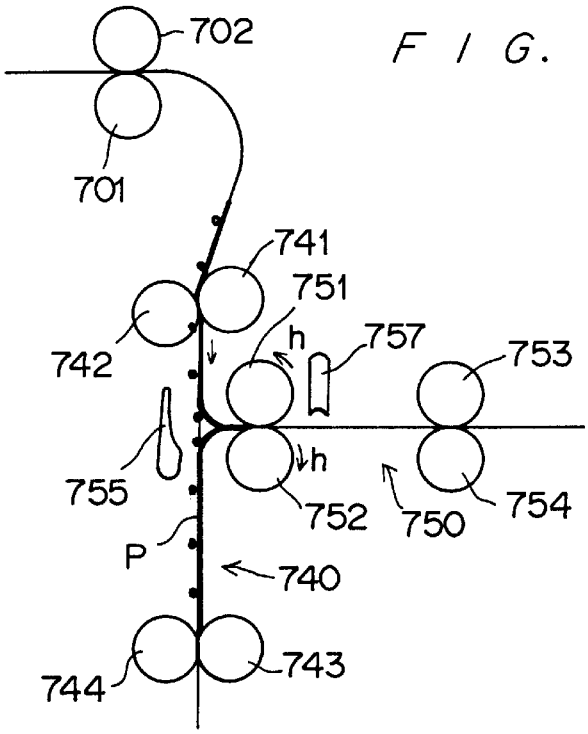
FIGS. 5*a*–5*d* are views explanatory of operation in a center stapling mode of a sheet folding/punching mechanism in the finisher unit.

In the center stapling/punching mode, each sheet is turned over by the sheet inversion unit 600 and delivered to the finisher unit 700. The sheet is conducted by the changeover pawl 703 to the longitudinal transport path 740. In this case, the solenoid SL1 is in "OFF" condition, and the changeover pawl 755 is held away from the longitudinal transport path 740. As FIG. 5*a* shows, a sheet P (with its imageformed side shown by dots) conducted into the longitudinal transport path 740 goes in contact, at its leading edge, with a nip portion between the transport rollers 743 and 744 which are in the state of rotation stop, whereupon the sheet P becomes bent at its center portion under a transport force imparted by transport rollers 741, 742 located above and is then threaded between the sheet folding rollers 751, 752 which are in rotation in the direction of arrow h, a fold being thus imparted.

Figure 5B:
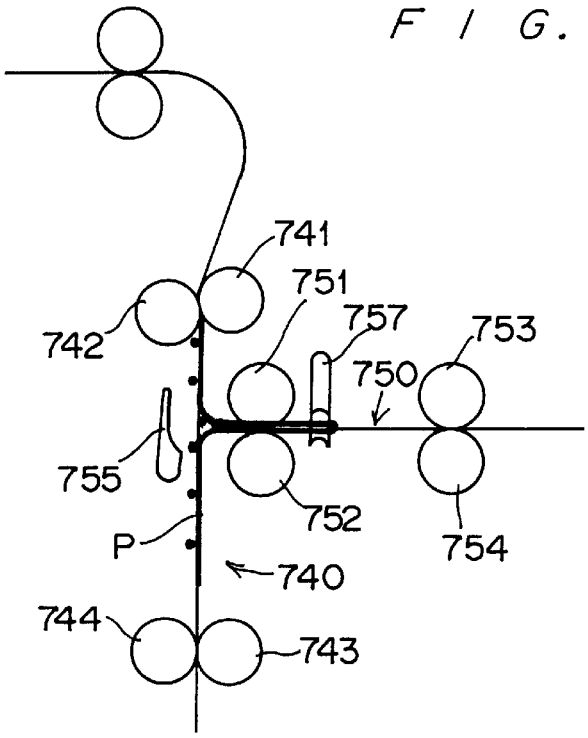

The sheet P, which was thus centrally folded with its image bearing side positioned inside, is transported in the rightward direction through the rotation of the sheet folding rollers 751, 752. Upon lapse of a predetermined time after detection by the sensor SE23 of the leading edge of the fold, the rotation of sheet folding rollers 751, 752 is stopped. At this time, the punching rod 757 operates one stroke to provide a punch hole near the fold line of the sheet P (see FIG. 5*b*).

Figure 5C:
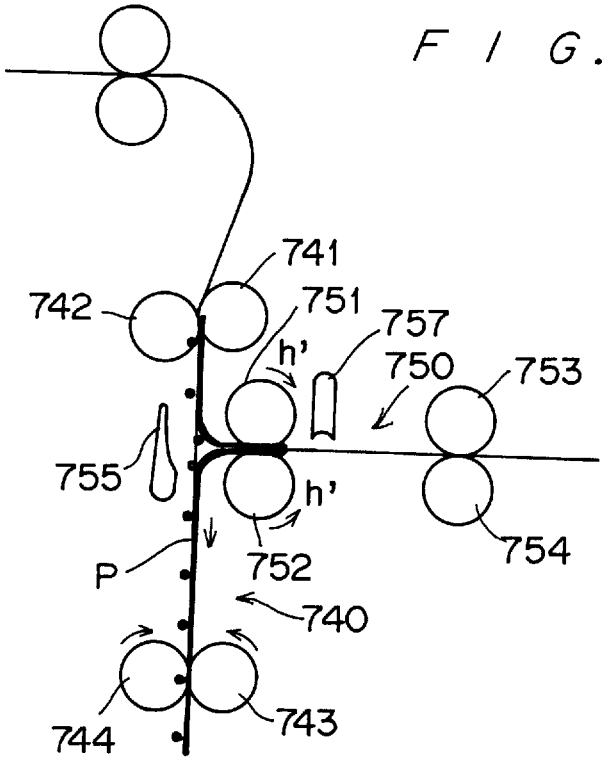
Figure 5D:
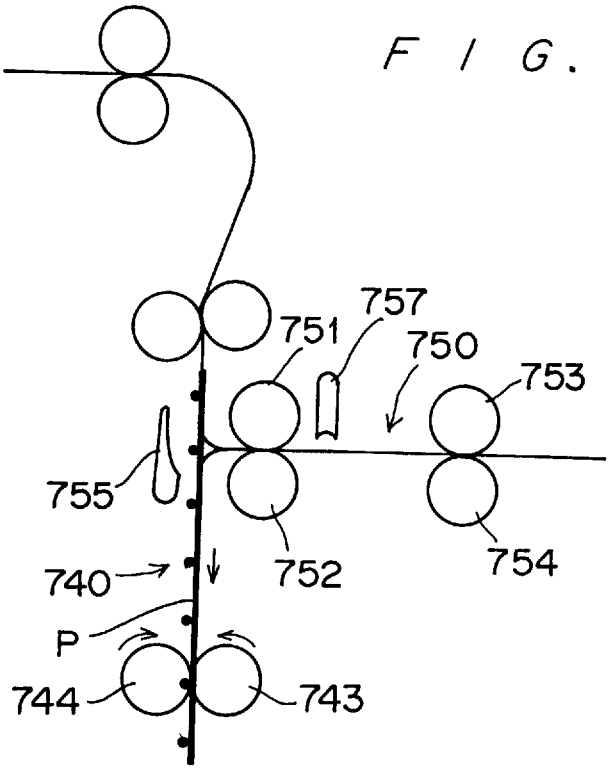

Subsequently, as FIG. 5*c* shows, the sheet folding rollers 751, 752 are driven in reverse in the direction of arrow h', and the transport rollers 743, 744 are driven into rotation, so that the sheet P is unfolded and transported downward along the longitudinal transport path 740 (see FIG. 5*d*).

Figure 6A:
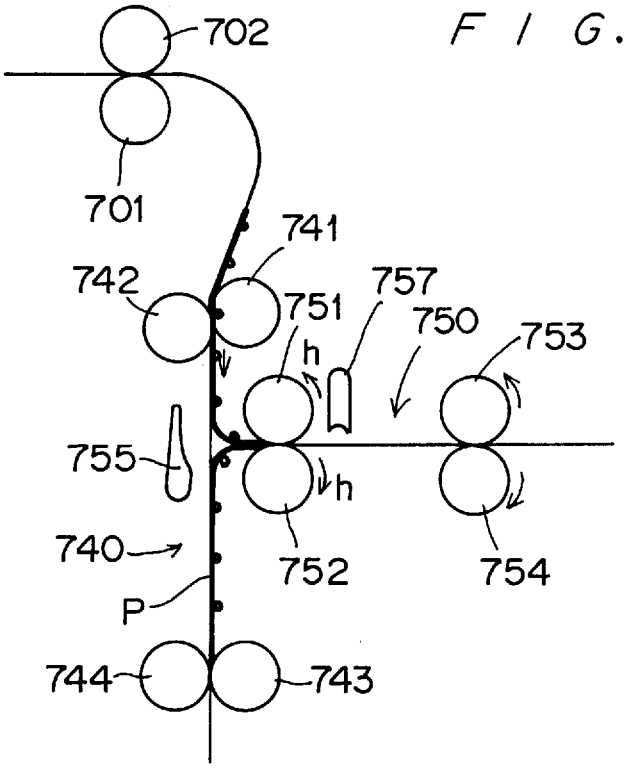
FIGS. 6*a*–6*d* are views explanatory of operation in a doubling mode of the sheet folding/punching mechanism in the finisher unit.
Figure 6B:
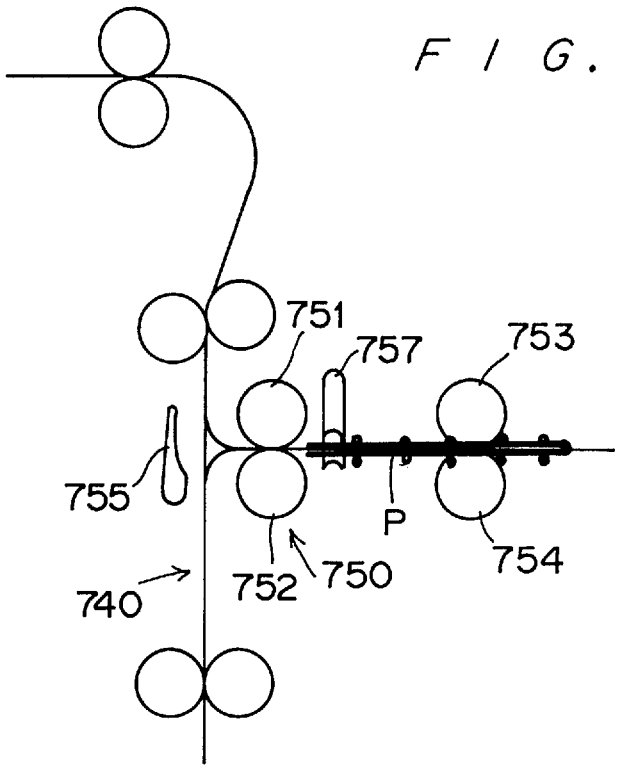

In the doubling/punching mode, each sheet, with its image-formed side facing up, is allowed to pass through the sheet inversion unit 600 and is fed direct into the finisher unit 700. As in the case of the center stapling/punching mode, the sheet is conducted into the longitudinal transport path 740, and the leading edge of the sheet goes in contact with the nip portion between the transport rollers 743, 744 which are in the state of rotation stop, whereupon the sheet becomes centrally bent and is threaded between the sheet folding rollers 751, 752 (see FIG. 6*a*). The sheet P, which was thus centrally folded with its image bearing side positioned outside, is transported rightward through rotation of sheet folding rollers 751, 752. Upon lapse of a predetermined time after detection by the sensor SE23 of the leading edge of the fold, the rotation of the sheet folding rollers 751, 752 is stopped. At this time, the punching rod 757 operates one stroke to provide a punch hole at a position opposite to the fold of the sheet P (see FIG. 6*b*).

Figure 6C:
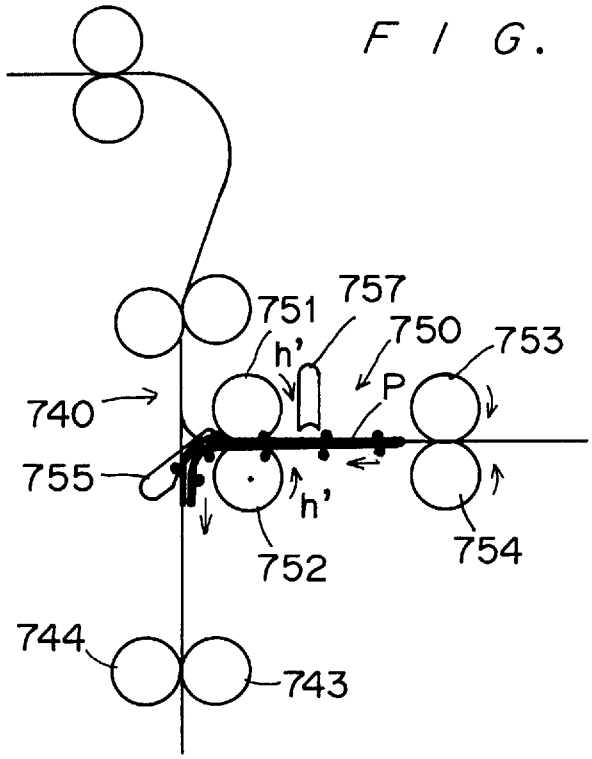
Figure 6D:
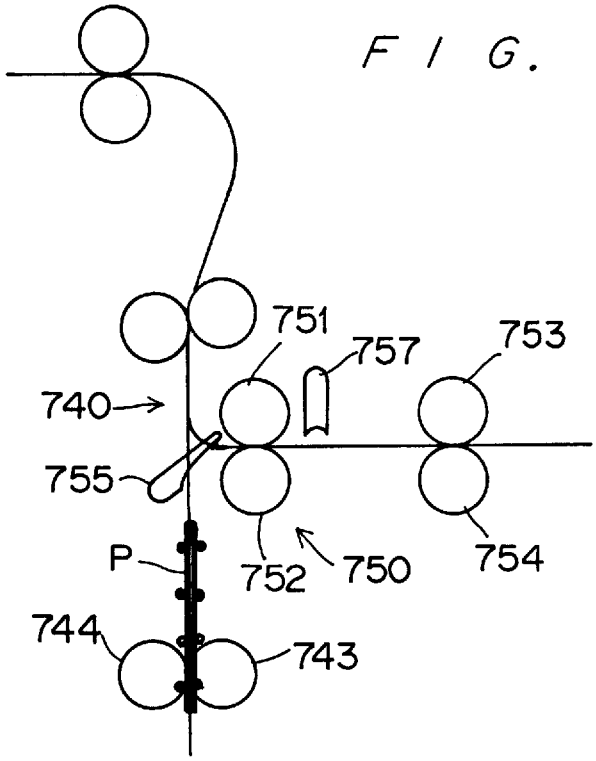

Subsequently, as FIG. 6*c* shows, the rotation of the sheet folding rollers 751, 752 is reversed in the direction of arrow h', and the solenoid SL1 is turned on to allow the changeover pawl 755 to enter the longitudinal transport path 740. Thereby, the sheet P is guided by the changeover pawl 755 for being transported downward along the longitudinal transport path 740. Further, the transport rollers 743, 744 are driven into rotation. As a result, the sheet P, doubled or folded in two, is transported downward (see FIG. 6*d*).

Staple Tray

The staple tray 760, as FIG. 2 shows, comprises two base plates 761, 762, guide plates 763, 764 opposed to the base plates 761, 762, a first stopper 765 and a second stopper 767. The staple tray 760 is set in position in a slightly inclined condition. The stoppers 765, 767, which are to regulate lower edges of sheets, are pivotally supported on support shafts 766, 768 respectively and are connected to a discharge solenoid not shown. In normal condition in which the discharge solenoid is in off state, the first stopper 765 engages a lower portion of the guide plate 763, and the second stopper 767 is positioned below the guide plate 764, whereby they are respectively operative to close the staple tray 760 to thereby regulate lower edges of sheets. When the discharge solenoid is turned on, the stoppers 765, 767 act to make the staple tray 760 open downward.

In the staple tray 760 there are provided a paddle 770, a stapler 771, a guide roller 772, and a sensor SE25 for detecting the presence or non-presence of sheets. The paddle 770, as in the case of the earlier described paddles 716, comprises flexible vane members disposed radially about a support shaft and is driven for rotation in the direction of arrow i. The paddle 770, through this rotation, goes in slide contact with sheet surface thereby to cause sheets delivered onto the staple tray 760, to be biased one by one in one direction for alignment.

The stapler 771 is of a well-known motorized type and includes a staple driver 771*a* having staples housed therein and, disposed in opposed relation thereto, a staple receiver 771*b* for receiving and bending staples driven. The staple driver 771*a* and staple receiver 771*b* are synchronously movable in a direction perpendicular to the direction of sheet receipt/discharge and are adapted to operate in such a way that through intermittent series of move and stop they perform stapling operation with respect to a set of sheets at each stop position. The guide roller 772 is pivotally mounted to a lower portion of a lever 773 movably mounted to the guide plate 763, and is specifically designed to prevent any puffing up of sheets received, without involving resistance.

According to the above described arrangement, when the center stapling mode is selected, as FIGS. 5*a* through 5*d* show, sheets with a fold line in the center are delivered one by one onto the staple tray 760 by the transport rollers 743, 744. At this time, the first stopper 765 is at a shunted position behind the base plate 761 as shown by dot line in FIG. 2, and the second stopper 767 projects onto the base plate 762 as shown by solid line, being ready to regulate lower edges of sheets. Therefore, individual sheets delivered onto the staple tray 760 are placed on the base plate 761 and second stopper 767, with lower edges of the sheets being regulated by the second stopper 767. In this way, sheets are sequentially placed one over another, with fold lines aligned to match stapling positions of the stapler 771. When sheets printed in one cycle have been accommodated, the stapler 771 is actuated to drive staples at plural points relative to the center fold of the set of sheets while moving in horizontal direction (center stapling). When such a cycle of center stitching is completed, the second stopper 767 pivots downward to open the bottom of the staple tray 760. Thereby, the stapled sheet set is discharged into the stacker 780.

For the purpose of this discharge, the paddle 770 is driven into rotation to impart a biasing force in the direction of discharge to the sheet set.

When the doubling/stapling mode is selected, as FIGS. 6*a* through 6*d* show, sheets folded centrally in two are delivered one by one onto the staple tray 760 by the transport rollers 743, 744. At this time, the first stopper 765 projects onto the base plate 761 as shown by solid line in FIG. 2, being ready to regulate lower edges of sheets, and the second stopper 767 is at a shunted position below the base plate 762 as shown by dot line in FIG. 2. Therefore, individual sheets delivered onto the staple tray 760 are sequentially placed on the first stopper 765, with leading edges of the sheets being regulated by the first stopper 765. When sheets printed in one cycle have been accommodated, the stapler 771 is actuated to drive staples at plural points on the opposite side from the fold of the set of sheets while moving in horizontal direction (double edge stapling). When such a cycle of closed stitching is completed, the first stopper 765 pivots downward, and concurrently, the paddle 770 goes into rotation. Thereby, the stapled sheet set is discharged into the stacker 780.

When a non-fold ordinary staple mode is selected, the stapler 771 carries out an operation similar to that of the foregoing doubling/stapling mode, and performs stapling with respect to the non-folded sheet set at a lower edge portion thereof.

At the discharge end of the staple tray 760 there is provided a sensor SE26 for detecting outgoing sheets.

Control Panel

Figure 7:
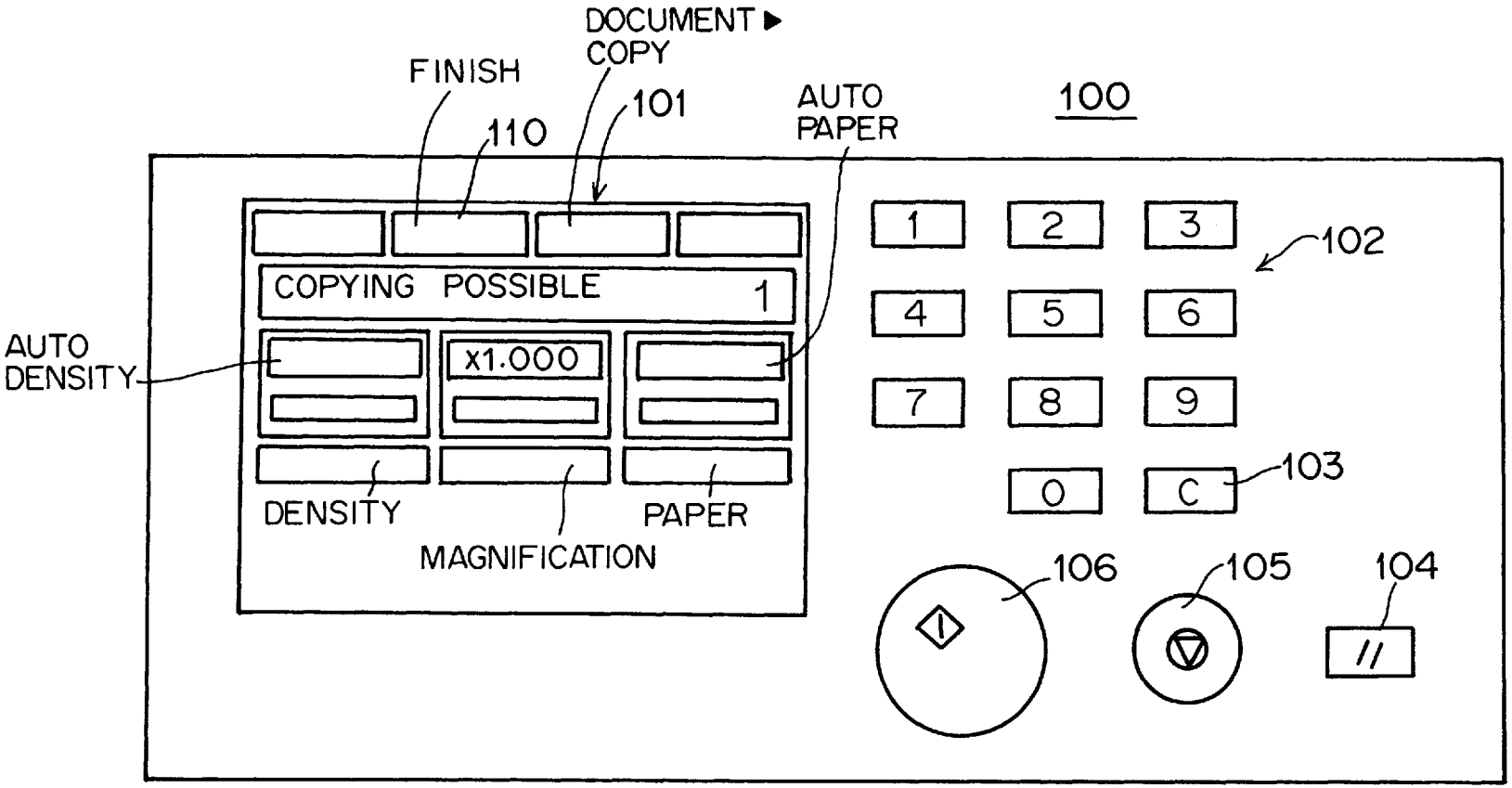
FIG. 7 is a plan view of a control panel, with a basic screen shown.
Figure 8:
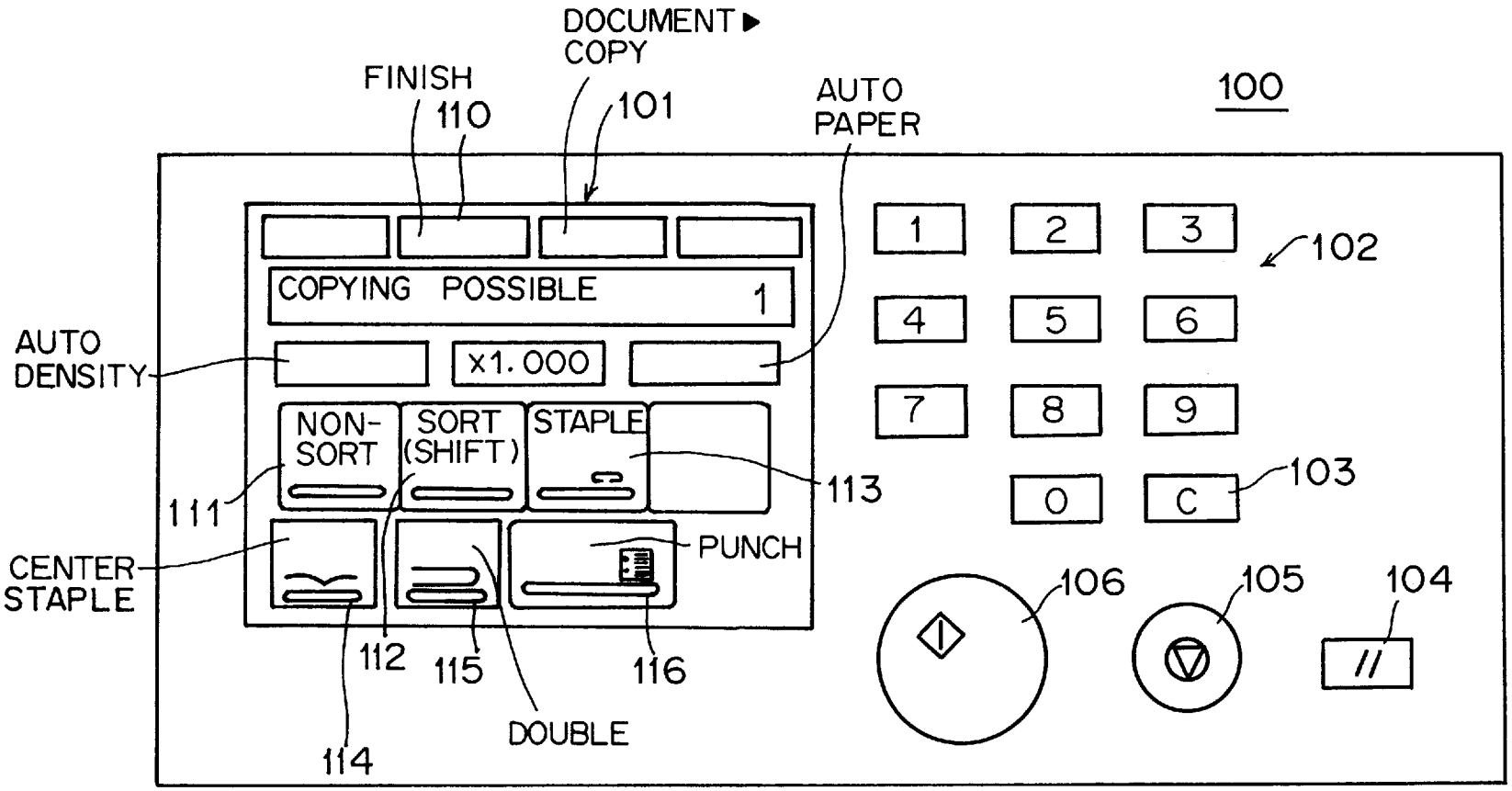
FIG. 8 is a plan view of the control panel, with a finish screen shown.

FIG. 7 shows a basic display on a control panel 100 disposed in the copying machine 1. FIG. 8 shows, by way of example, a control display (finish display) thereof. The control panel 100 includes a liquid crystal touch panel 101 for displaying the status of the copying system and setting various modes, a ten key pad 102 for inputting numerical conditions for printing (number of prints, number of punched sets, etc.), a clear key 103 for returning numerical conditions to initial values, a reset key 104 for initializing print mode, a stop key 105 for instructing print operation stop, and a start key 106 for instructing print operation start.

A basic display of the liquid crystal touch panel 101 is shown in FIG. 7. Factors, such as density and magnification, are preset on this display. When an operator turns on a finish switch 110, the screen of liquid crystal touch panel 101 changes into a finish screen as shown in FIG. 8. Displayed played on this screen are a non-sort mode switch 111, a sort mode switch 112, a staple mode switch 113, a center stitch mode switch 114, a doubling mode switch 115 and a punch mode switch 116. When each of the switches 111 through 116 is pressed one time, the corresponding mode is selected, and when the switch is pressed second time, the mode is canceled.

Control Circuitry

Figure 9:
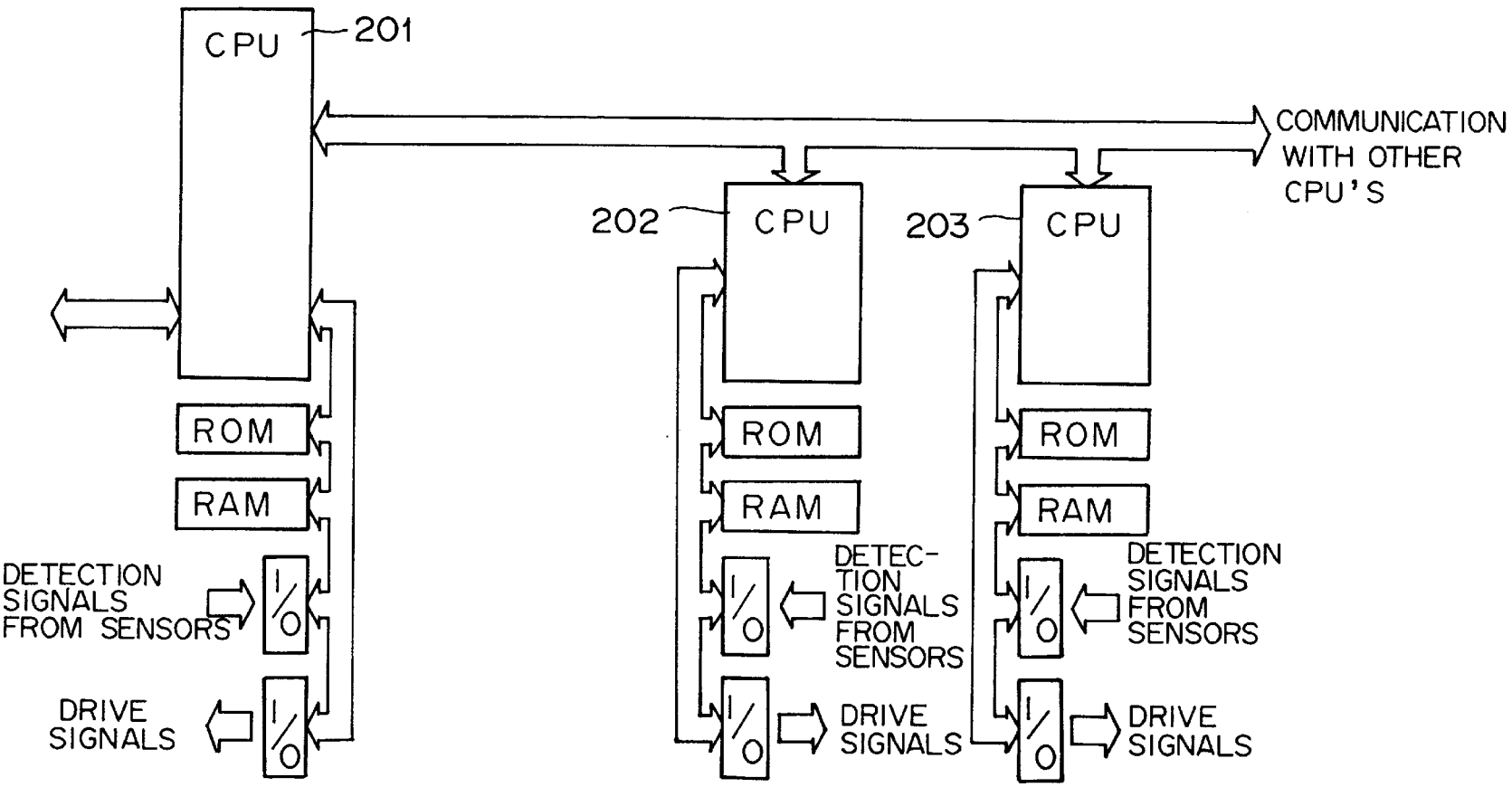
FIG. 9 is a block diagram showing a controller of the copying system.

FIG. 9 shows a control section of the copying system which includes, as principal units, a CPU 201 for controlling the copying machine 1, a CPU 202 for controlling the ADF 500, and a CPU 203 for controlling the finisher unit 700. Each of the CPUs 201, 202, 203 has a built-in ROM, a built-in RAM, a signal input section where signals from sensors are received, and a signal output section where drive signals are sent to various elements. These CPUs 201, 202 and 203 can exchange signals with one another.

Reading-out of Image Data and Copying

In the present embodiment, in copying a plural number of pages, first, images of all the pages are read by an image reader unit 10, and the image data of all the pages are stored in a memory unit 19. In a case of making a plural number of copy sets, reading-out of the image data from the memory unit 19 is carried out a plural number of times, and copies are discharged from the copying machine 1 in order of page.

For example, a case in which documents of page 1 through page 12 are copied in a simplex mode (a copy image is formed on only one side of each sheet) or in a duplex mode (copy images are formed on both sides of each sheet) are hereinafter described. In either mode, image data of the twelve documents are read out and from the memory unit 19 and copied in reverse order from page 12 to page 1. This reading-out/copying cycle is repeated a number of times corresponding to the number of copy sets to be made.

When copy sets with each sheet simplex copied and folded in two are made, in each reading-out/copying cycle, the image data are read out in reverse order from page 12, two pages at one time. Specifically, image data of page 12 and page 11 are read out and copied on a first copy sheet side by side, and image data of page 10 and page 9 are read out and copied on a second copy sheet side by side. In this way, two image are copied on one sheet. This cycle is repeated until a number of copy sets designated by an operator are made.

On the other hand, when center stapled copy sets with each sheet duplex copied are made, in each reading-out/copying cycle, the image data are read out in order from page 12 and from page 1, two pages at one time. Specifically, an image of page 12 and an image of page 1 are read out and copied on a first side of a first copy sheet side by side, and an image of page 11 and an image of page 2 are read out and copied on a second side of the first copy sheet side by side. An image of page 10 and an image of page 3 are copied on a first side of a second copy sheet, and an image of page 9 and an image of page 4 are copied on a second side of the second copy sheet. This cycle is repeated until a numbed of copy sets designated by an operator are made.

In the following description, the term "job" means a cycle of process in which a set of images are read out to make one copy set.

Control Procedures

Control procedures for the copying system will now be described with reference to flow charts shown in FIGS. 10 through 21*d*.

Figure 10:
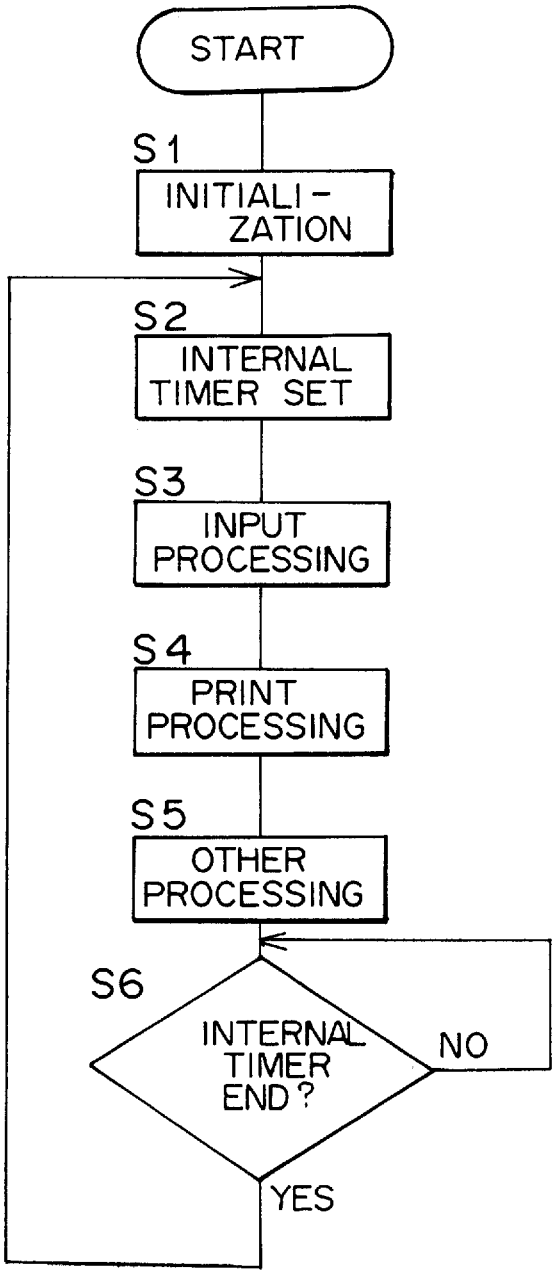
FIG. 10 is a flow chart showing a main routine of a first CPU for controlling a copying machine.

FIG. 10 shows a main routine of the CPU 201 for control of the copying machine 1. After program starts, at step S1, clearing of the RAM, resetting of registers and initialization for setting various units to initial mode are carried out. Then, an internal timer is set on at step S2. The internal timer is to set the time required for one routine in the main routine, and the value for the time is set at step S1.

Next, sub-routines for steps S3. S4 and S5 are sequentially called and necessary processing is carried out as required. Then, at step S6, the CPU returns to step S2 upon time ending of the internal timer. Step S3 is for processing input signals from the control panel 100; step S4 is for carrying out printing at the copying machine 1; and step S5 is for performing other processing operations, such as sheet feed/transport, temperature control for fixation device 42, paper jam detection, etc.

Figure 11A:
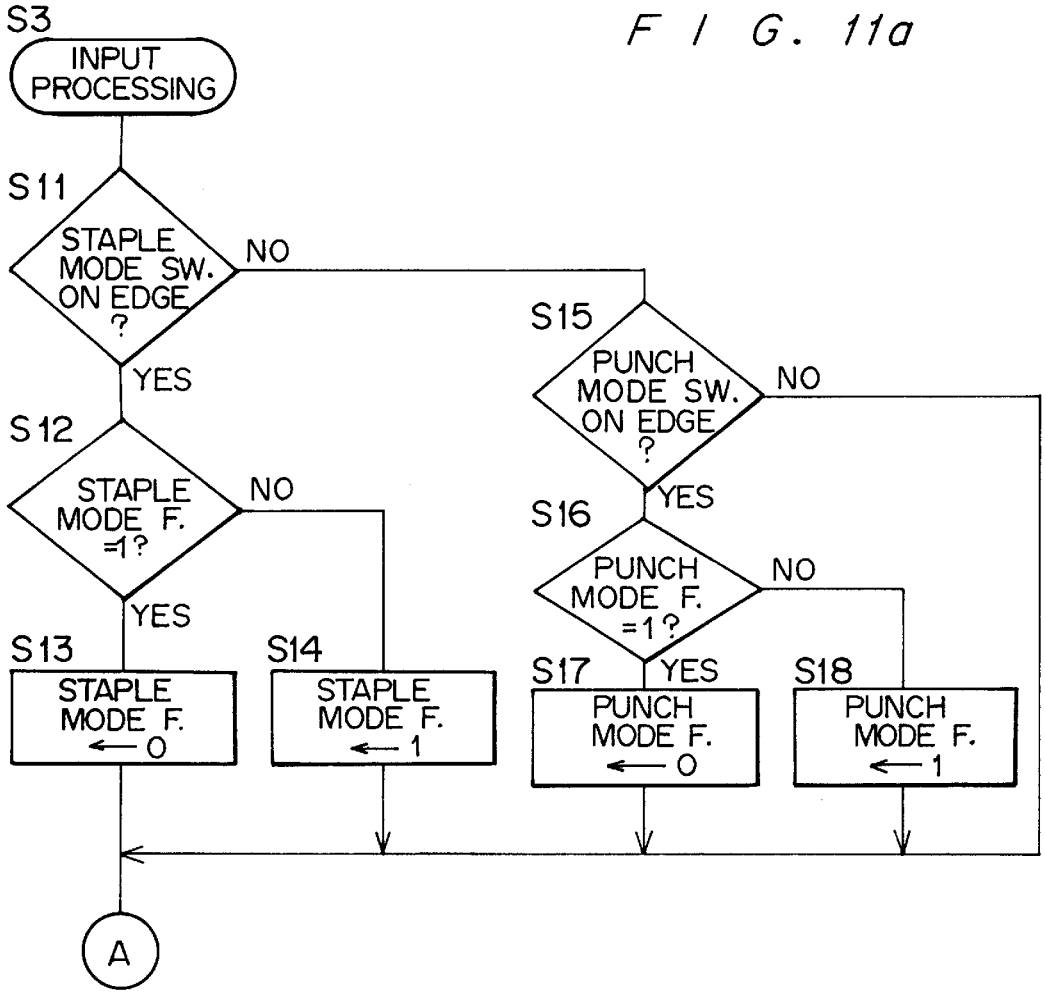
FIGS. 11*a*–11*c* are flow charts showing a sub-routine for input processing by the first CPU.
Figure 11B:
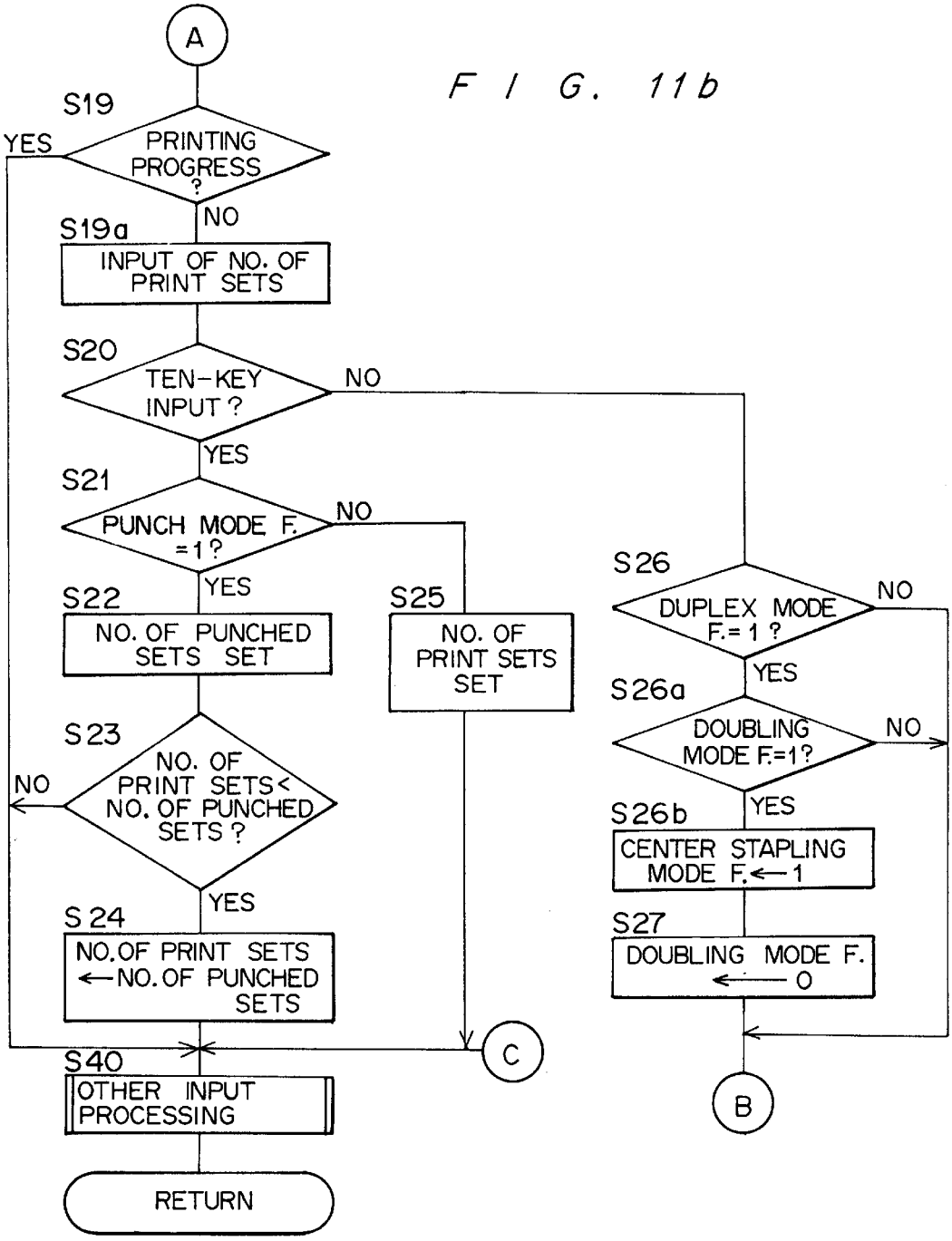
Figure 11C:
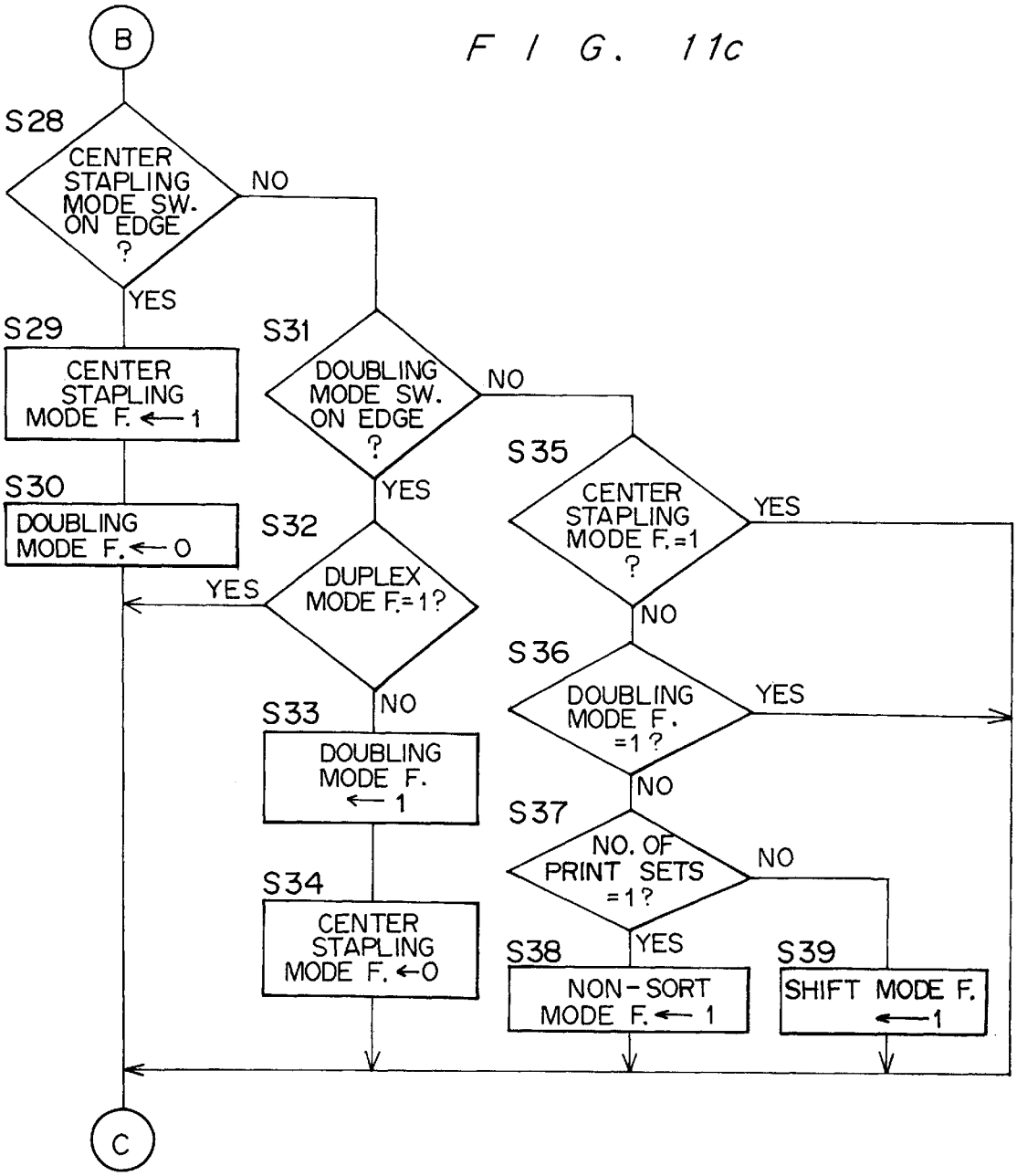

FIGS. 11*a*–11*c* show sub-routines for input processing operations to be executed at step S3.

First, at step S11, a decision is made whether the staple mode switch 113 is on edge or not. The term "on edge" means the condition of the switch as changed over from "off" to "on". If "YES" at step S11, then at step S12 a decision is made whether the staple flag is "1" or not. When the staple flag is "1", an instruction is given to execute stapling. If it is "0", cancellation of stapling is instructed. When the staple mode flag is set to "1", at step S13 the staple mode flag is reset to "0". If it has been reset to "0", at step S14, the staple mode flag is set to "1", and the program proceeds to step S19. If "NO" at step S11, then at step S15, a decision is made whether the punch mode switch 116 is on edge or not. If the decision is "YES", at step S16, decision is made whether a punch mode flag is "1" or not. The punch mode flag instructs execution of punching operation when it is "1", while it instructs cancellation of punching when it is "0". If the punch mode flag is set to "1", at step S17, the flag is reset to "0"; and if the flag is reset to "0", then at step S18, the flag is set to "1", and the program proceeds to step S19.

As may be understood from the above, "on" input of the switches 113, 116 at steps S11, S15 is accepted at any time (even during printing operation). More specifically, even during printing operation, staple mode setting or cancellation and punch mode setting or cancellation are possible with respect to a next job of print sheets; and even when an error is made in selecting a mode, setting may be changed in the middle of the processing operation.

At step S19, a decision is made whether a printing operation is still on or not. If "YES", the program goes to step S40. If not, at step S19*a,* a number of print sets) is input, and at step S20, a decision is made whether or not there is an input from ten-key 102. If there is an input, at step S21, a decision is made whether or not the punch mode flag is "1". If the flag is set to "1", then at step S22 the numerical value input from ten key 102 is set as a number of punched sets. Then, at step S23, the number of print sets) and the number of punched sets is compared, and if the number of print sets is smaller than the number of punched sets, at step S24, the number of punched sets is set as a set number. The program then advances to step S40. If the punch mode flag is reset to "0" (that is, "NO" at step S21), then at step S25, a numerical value from ten- key 102 is set as a set number, and the program goes to step S40.

On the other hand, if "NO" at step S20, then at step S26, a decision is made whether or not a duplex mode flag is "1". Although the duplex mode flag is not shown in the flow chart, if the duplex mode is selected, the flag is set to "1". If the duplex mode flag is set to "1", then at step S26*a,* a decision is made whether a doubling mode flag is "1" or not. If the flag is set to "1", then at step S26*b*, the center stapling mode flag is set to "1", and at step S27, the doubling mode flag is reset to "0". That is, if a duplex printed sheet is folded in two, and if the folded sheet is edge-stapled, the image on one side becomes internally hidden; therefore, for the purpose of stapling duplex printed sheets, the doubling/stapling processing is forcibly canceled. In this case, therefore, stapling operation is set to the center stapling mode.

If the decision at step S26 or S26*a* is "NO", then at step S28 the CPU checks that the center stitch mode switch 114 is on edge and then, at step S29, the center stapling mode flag is set to "1", whereby execution of the center stapling mode is instructed. Then, at step S30, the doubling mode flag is reset to "0". If, at step S31, it is verified that the doubling mode switch 115 is on edge, then at step S32 a decision is made whether the duplex mode flag is "1" or not. If the flag is set to "1", then the program advances to step S40. Only when the duplex mode flag is reset to "0", the doubling mode flag is set to "1" at step S33, thereby instructing execution of the doubling mode. Then, at step S34, the center stapling mode flag is reset to "0".

If, at step S35, it is verified that the center stapling mode flag is not set to "1", and if, at step S36, it is verified that the doubling mode flag is not set to "1", then at step S37 decision is made whether the number of print sets is "1" or not; and if the number is "1", then at step S38 a non-sort mode flag is set to "1", and the program advances to step S40. The non-sort mode flag, when it is "1", instructs not to allow the discharge tray 720 to shift. If the preset number is not "1", that is, if the preset number is "2" or above, then at step S39 a shift mode flag is set to "1", and the program proceeds to step S40. The shift mode flag, when it is "1", instructs execution of a processing operation such that the discharge tray 720 is laterally shifted each time a printed sheet is received onto the discharge tray 720.

At step S40, input signals from the control panel 100 other than the above described are processed for print mode setting.

Figure 12A:
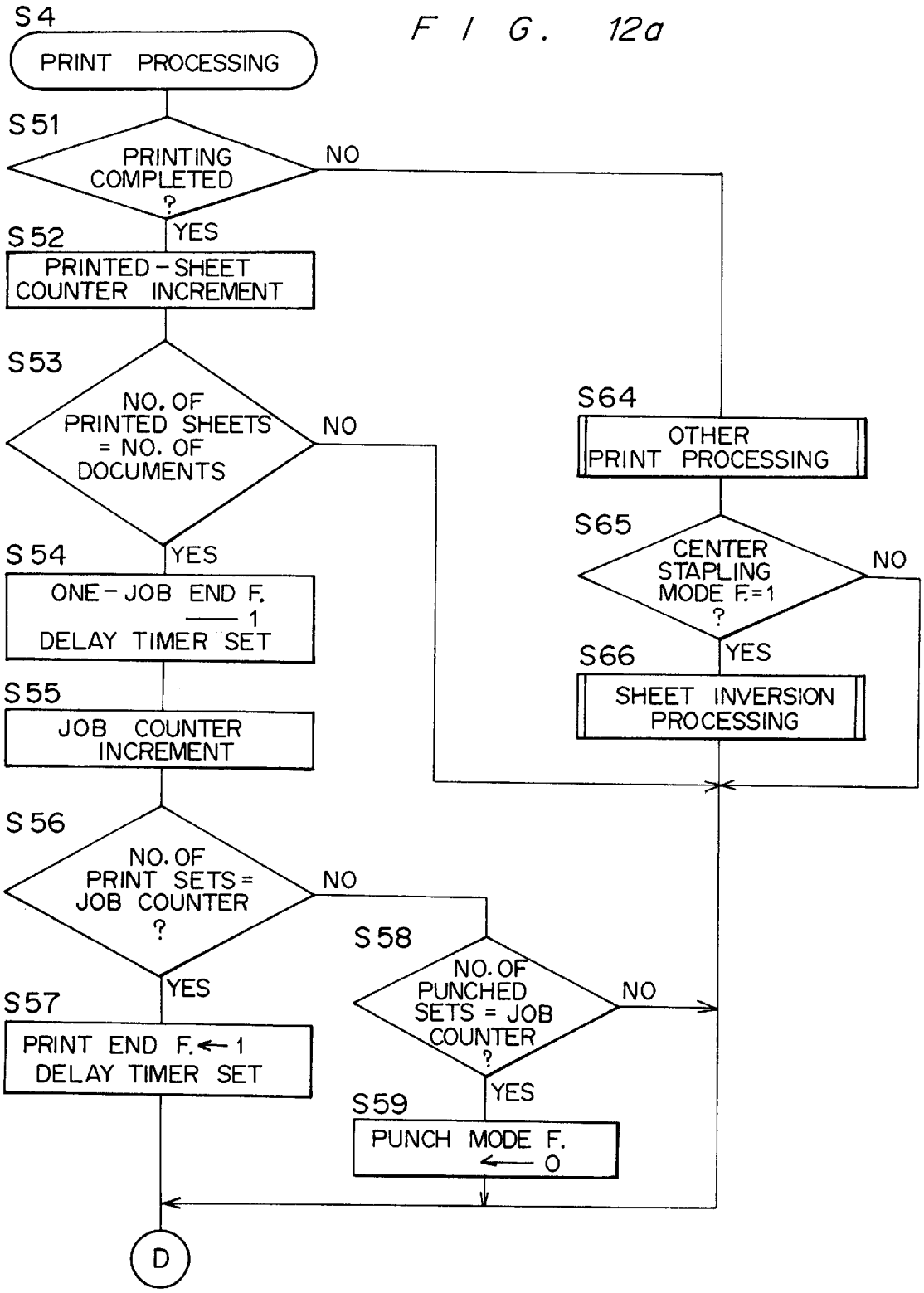
FIGS. 12*a* and 12*b* are flow charts showing a sub-routine for printing operation by the first CPU.
Figure 12B:
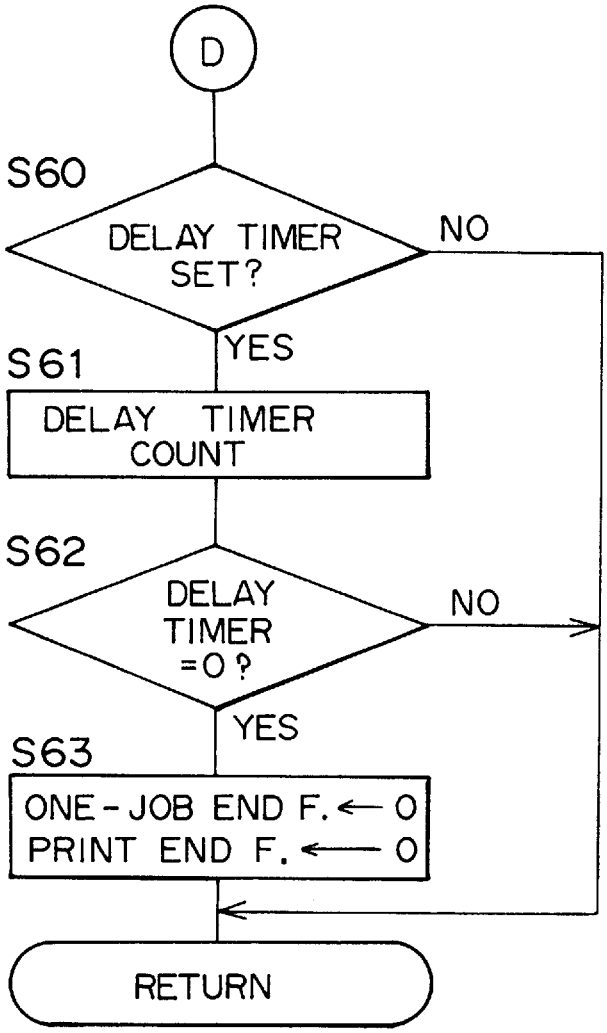

FIGS. 12*a,* 12*b* show sub-routines for printing operation to be executed at step S4.

First, at step S51, a decision is made whether a printing operation for one sheet has been completed or not. If not, at step S64, the printing operation is carried out, and then at step S65 decision is made whether the center stapling mode flag is "1" or not. If the flag is set to "1", then at step S66 sheet inversion processing by the sheet inversion unit 600 is carried out. Then, the program goes to step S60. If one-set printing has been completed, then at step S52, a printed-sheet counter is incremented, and at step S53 the number of printed sheets (count of the printed-sheet counter) is compared with the number of documents. If the two are not equal, printing of a next sheet is necessary, and accordingly the program goes to step S60. If the two are equal, it is judged that a printing operation for one set has been completed. Then, at step S54, a one-job end flag is set to "1", and delay timer setting is made. Further, at step S55, a job counter is incremented accordingly.

Next, at step S56, the number of print sets is compared with the count of the job counter. If the two values are equal, it is judged that all printing operation has been completed. Then, at step S57, a print end flag is set to "1", and a delay timer is set accordingly. Then, the program advances to step S60. If the two values are not equal, then at step S58, the number of punched sets is compared with the count of the job counter. If the two values are not equal, then the program proceeds to step S60. If they are equal, any further punching operation is unnecessary; and therefore, at step S59, the punch mode flag is reset to "0", and the program proceeds to step S60.

At step S60, it is verified that the delay timer is set in order, and at step S61 the delay timer is counted. If, at step S62, it is determined that the delay timer has been counted to "0", then at step S63, the one-job end flag and the print end flag are reset to "0".

Figure 13:
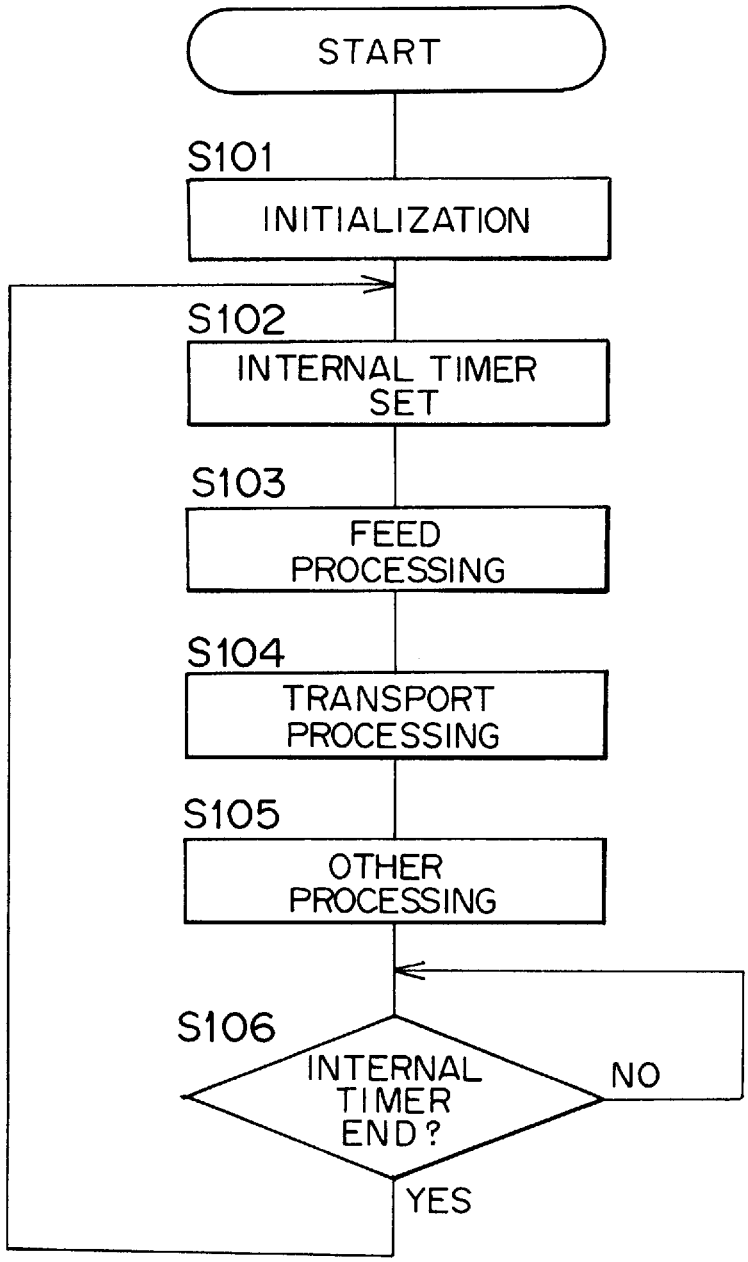
FIG. 13 is a flow chart showing a main routine of a second CPU for controlling an ADF.

FIG. 13 shows a main routine of the CPU 202 for control of the ADF 500. After program starts, at step S101, clearing of the RAM, resetting of registers and initialization for setting various units to initial mode are carried out. Then, an internal timer is set on at step S102. The internal timer is to set the time required for one routine in the main routine, and the value for the time is set at step S101.

Next, sub-routines for steps S103. S104 and S105 are sequentially called, and necessary processing is carried out as required. Then, at step S106, the CPU returns to step S102 upon time ending of the internal timer. Step S103 is for feeding documents from the stacker 501; step S104 is for carrying out transport of documents onto the document glass 9; and step S105 is for performing other processing operations, such as discharge of documents onto the tray 525.

Figure 14:
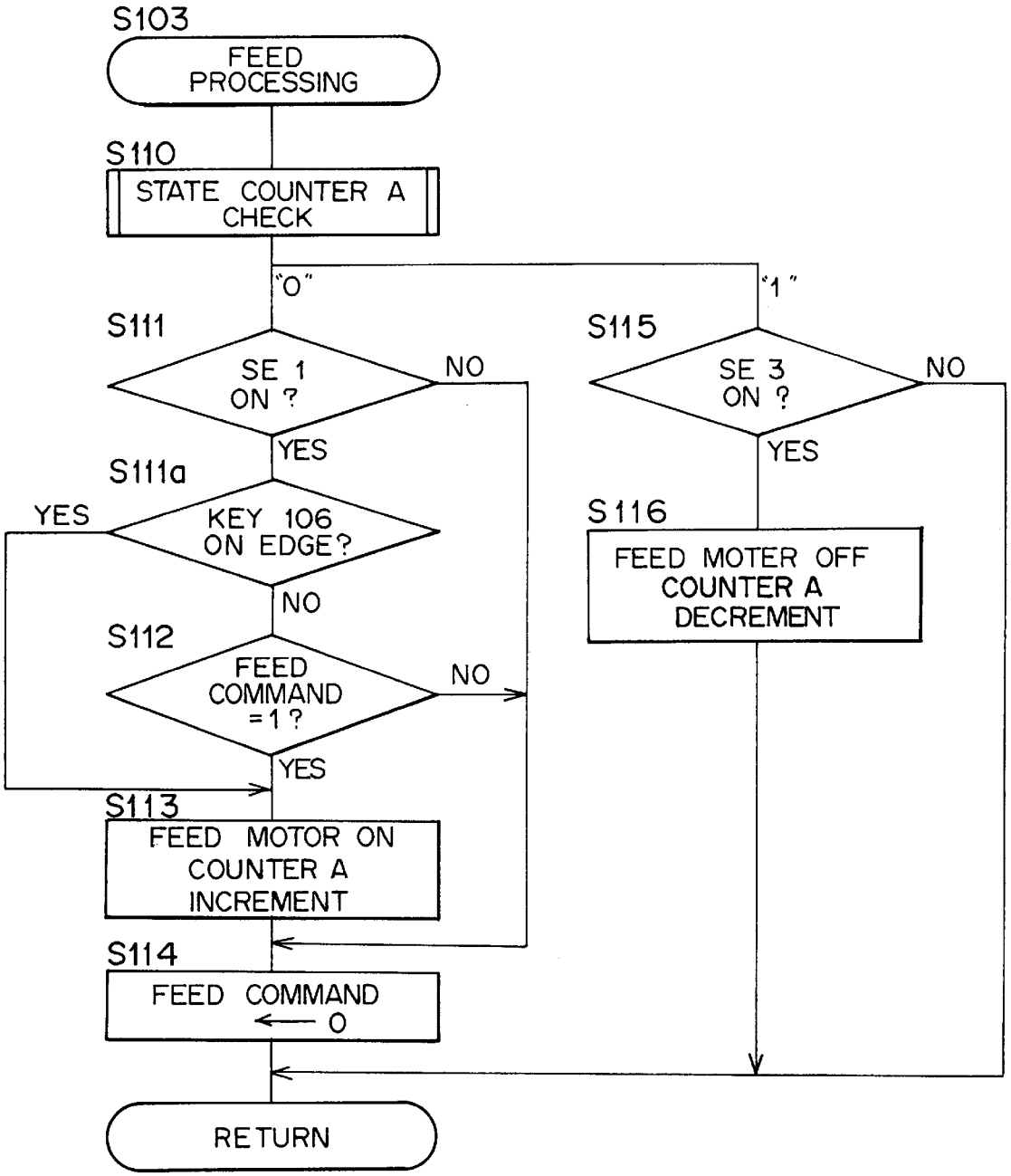
FIG. 14 is a flow chart showing a sub-routine for sheet feed operation by the second CPU.

FIG. 14 shows a sub-routine to be executed at step S103 for feed of documents. In this sub-routine, the count of a state counter A is checked at step S11O, and the following operations are carried out according to the count.

When the counter A is "0", at step S11 the presence or non-presence of documents on the stacker 501 is determined from the "on" or "off" indication of the sensor SE1. If the sensor SE1 is "off", that is, no documents are present, then at step S114, a feed command is reset to "0", whereby the program ends this sub-routine. If the sensor SE1 is "on", that is, a document is present, then at step S111*a*, a decision is made whether the print start key 106 is on edge or not. If not, at step S112 it is determined whether the feed command is "1" or not. The feed command, which has been initialized or reset to "0", instructs document feed when it is "1" (see step S124 in FIG. 15). If the feed command has been set to "1", then at step S113, the feed motor is switched on, and the counter A is incremented accordingly. If the print start key 106 is on edge, then the program proceeds to step S113. Processing at step S113 results in feed of one document from the document stack on the stacker 501. Then, at step S114, the feed command is reset to "0".

When the counter A is "1", at step S115 it is determined whether a document has been fed or not, from the "on" or "off" indication of the sensor SE3. If the sensor SE3 is "on", that is, feed of a document is verified, then at step S116, the feed motor is switched off, and the counter A is decremented accordingly.

Figure 15:
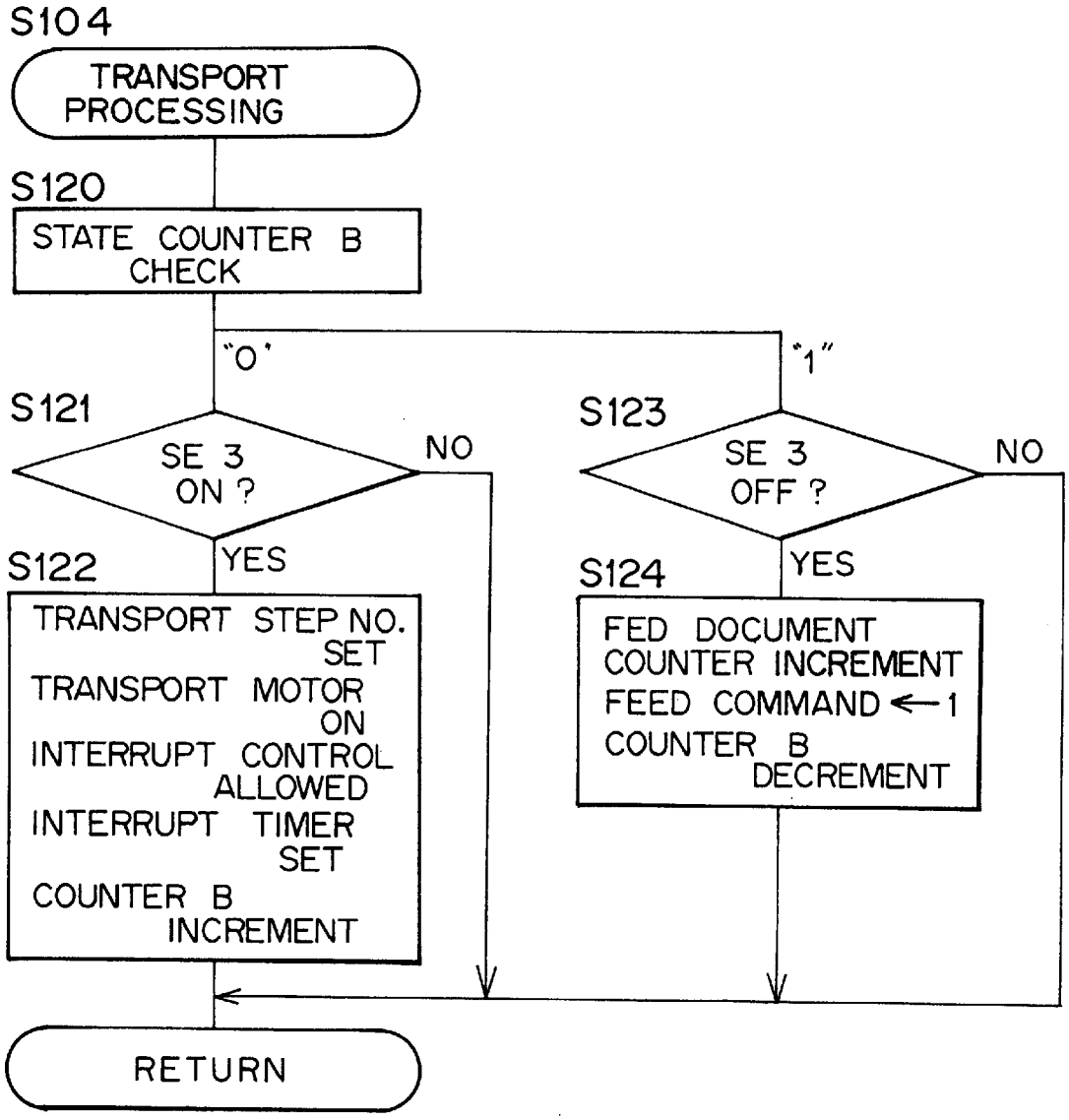
FIG. 15 is a flow chart showing a sub-routine for transport operation by the second CPU.

FIG. 15 shows a sub-routine for transport processing to be executed at step S104. In this sub-routine, the count of a state counter B is checked at step S120, and the following operations are carried out according to the count.

When the counter B is "0", at step S121 it is determined whether a document has been fed or not, from the "on" or "off" indication of the sensor SE3. If the sensor SE3 is "on", that is, feed of a document is verified, then at step S122, setting of a transport step number for a drive of the transport motor is made, the transport motor is switched on for excitation, interrupt control is enabled, and interrupt time setting is made. Further, the counter B is incremented accordingly.

When the counter B is "1", at step S123 it is determined whether a document has passed or not, from the "on" or "off" indication of the sensor SE3. If the sensor SE3 is "off", that is, a document has passed the sensing point of the sensor SE3, then at step S124 the counter for counting the number of documents fed is incremented accordingly, and the feed command is set to "1". Further, the counter B is decremented accordingly.

Figure 16:
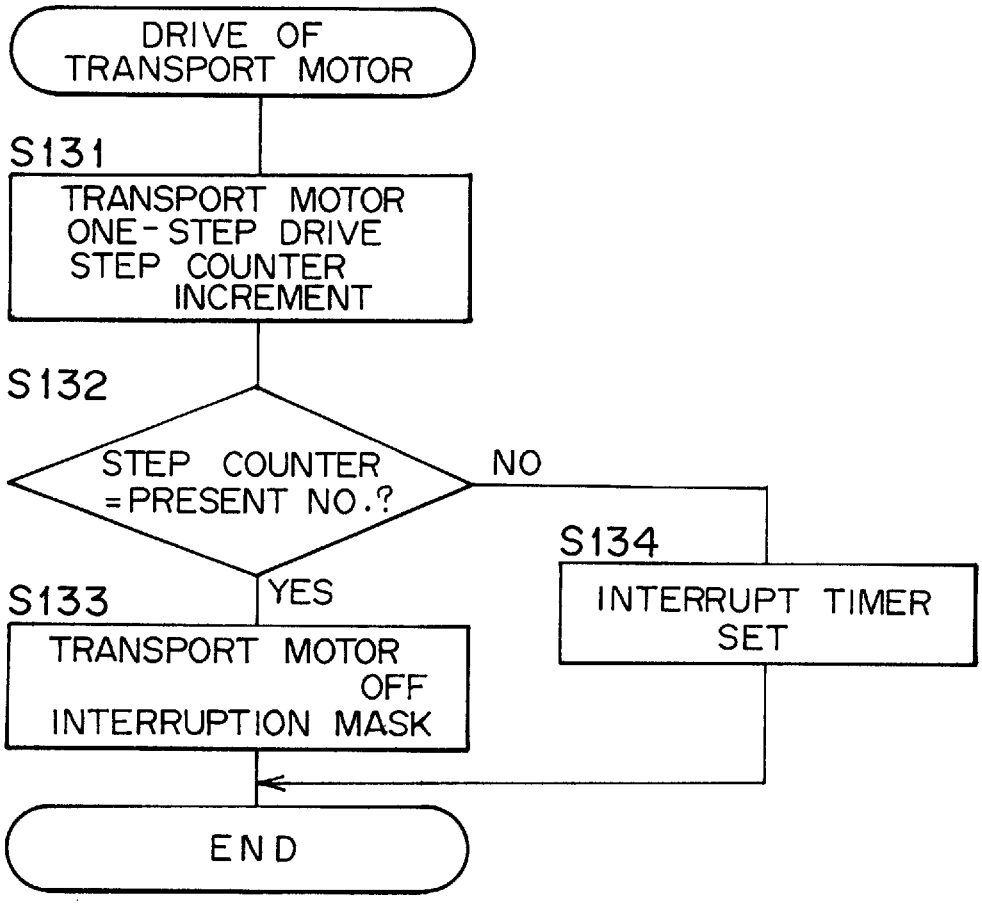
FIG. 16 is a flow chart showing a sub-routine for transport motor actuation by the second CPU.

FIG. 16 is a sub-routine for a drive of the transport motor which is to be executed as interrupt processing to the main routine illustrated in FIG. 13. First, at step S131, the transport motor is driven by one step, and a step counter is incremented accordingly. If, at step S132, it is determined that the count of the step counter has become equal to a preset number (see step S122 in FIG. 15), then at step S133 transport motor excitation is switched off, and interruption masking is effected. At step S134, an interrupt timer is set on until the count of step counter has reached the preset number ("NO" at step S132).

Figure 17:
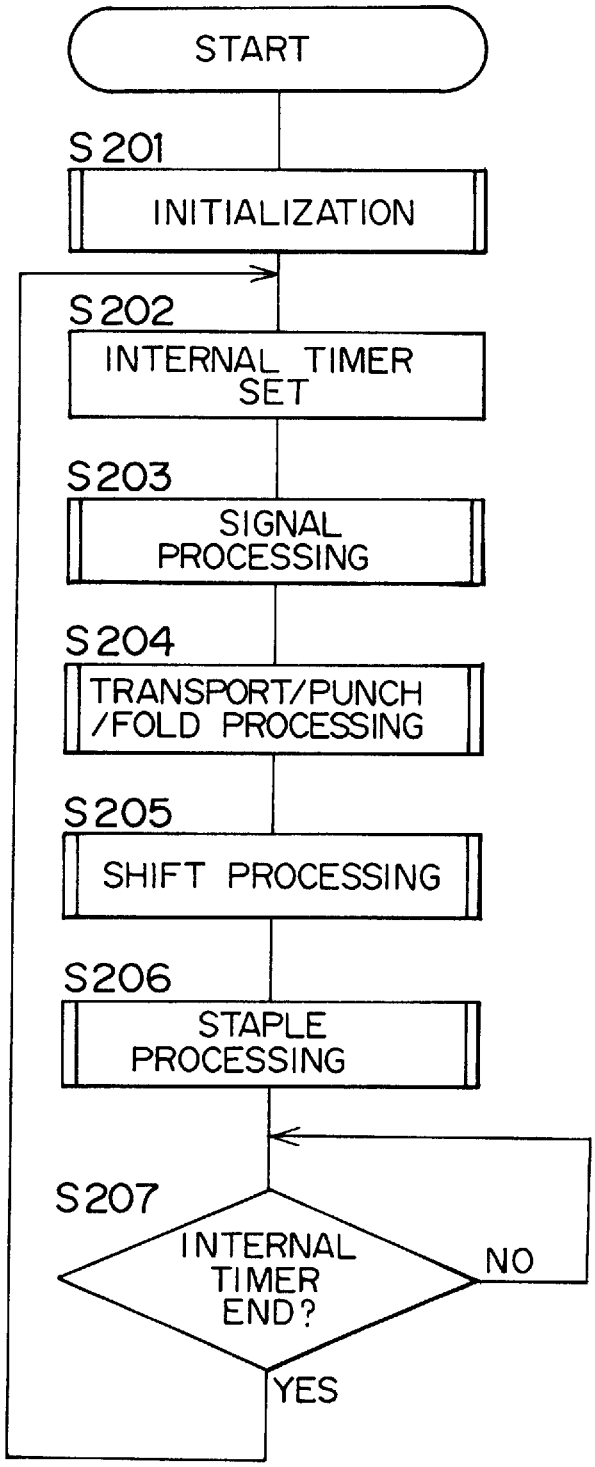
FIG. 17 is a flow chart showing a main routine of a third CPU for control of the finisher unit.

FIG. 17 shows a main routine of the CPU 203 for control of the finisher unit 700. After program starts, at step S201 clearing of the RAM, resetting of registers and initialization for setting various units to initial mode are carried out. Then, an internal timer is set on at step S202. The internal timer is to set the time required for one routine in the main routine, and the value for the time is set at step S201.

Next, sub-routines for steps S203, S204, S205 and S206 are sequentially called, and necessary processing is carried out as required. Then, at step S207, the CPU returns to step S202 upon time ending of the internal timer. Step S203 is for accepting process mode signals and operation signals transferred from the CPU 201 to determine an operation mode of the finisher unit 700 and also for carrying out processing of other signals. Step S204 is for carrying out sheet transport/punching/folding operations within the finisher unit 700. Step S205 is for execution of shift operation of the discharge tray 720. Step S206 is for execution of stapling operation in the staple tray 760.

Figure 18:
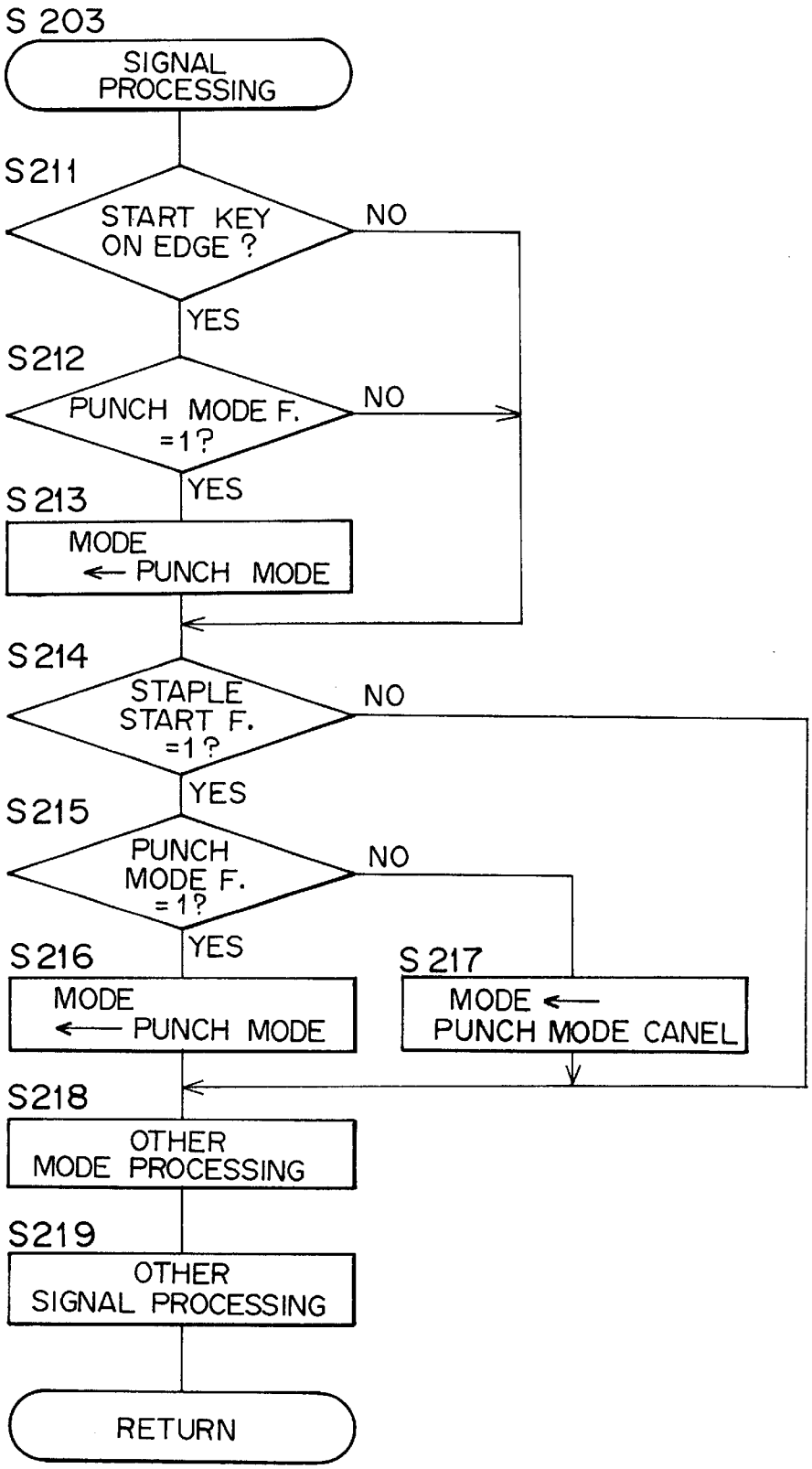
FIG. 18 is a flow chart showing a sub-routine for signal processing by the third CPU.

FIG. 18 shows a sub-routine for signal processing to be executed at step S203.

First, at step S211, it is determined that the start key 106 is on edge, and then at step S212 a decision is made whether the punch mode flag is "1" or not. If the flag has been set to "1", then at step S213, a processing mode of the finisher unit 700 is set to the punch mode. Next, at step S214, a decision is made whether a staple start flag is "1" or not. If the flag has been set to "1", then at step S215 a decision is made the punch mode flag is "1" or not. The staple start flag, when it is "1", indicates that printing of one job (one set) ends and that printed sheets have been accommodated in the finisher unit 700 (see step S225 in FIG. 19). If the punch mode flag is set to "1", then at step S216, the processing mode is set to the punch mode, while if the flag is reset to "0", at step S217 the punch mode is canceled. That is, each time accommodation of one job (one set) of sheets is completed, it is determined whether the punch mode has been set or not, and if the punch mode is already set, punching is carried out with respect to printed sheets for a next job. If the punch mode has been canceled, punching is released with respect to sheets printed for a next job.

In the present arrangement, each time sheet accommodation for one job comes to an end, a decision is made for setting/cancellation of the punch mode. Similarly, for setting/cancellation of the staple mode, it may be arranged that a decision is made whether or not the staple mode has been set and that the staple mode is set on or canceled according to that decision.

Next, at step S218, for mode setting other than the above described, processing is carried out on the basis of mode signals transferred from the CPU 201. Further, at step S219, a signal transferred from the CPU 201 with respect to the state of operation of the copying machine 1 is processed.

Figure 19:
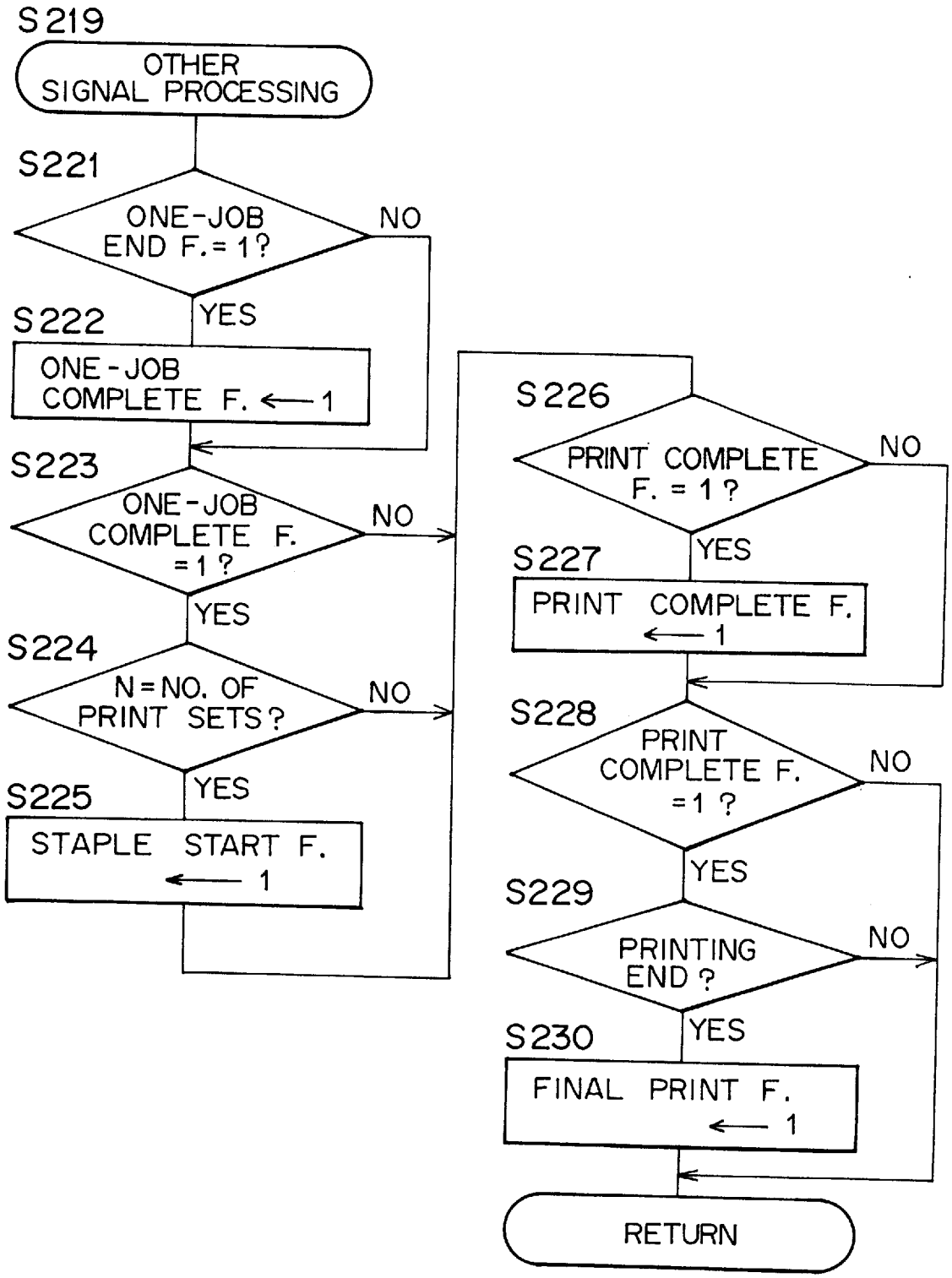
FIG. 19 is a flow chart showing a sub-routine for other signal processing by the third CPU.
Figure 20A:
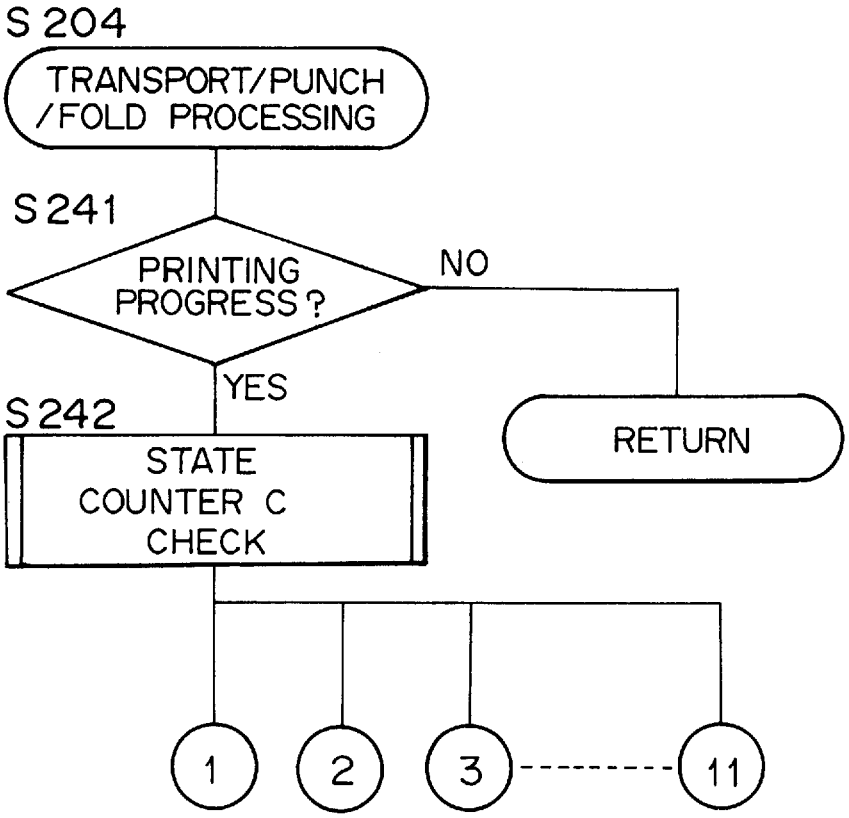
Figure 20B:
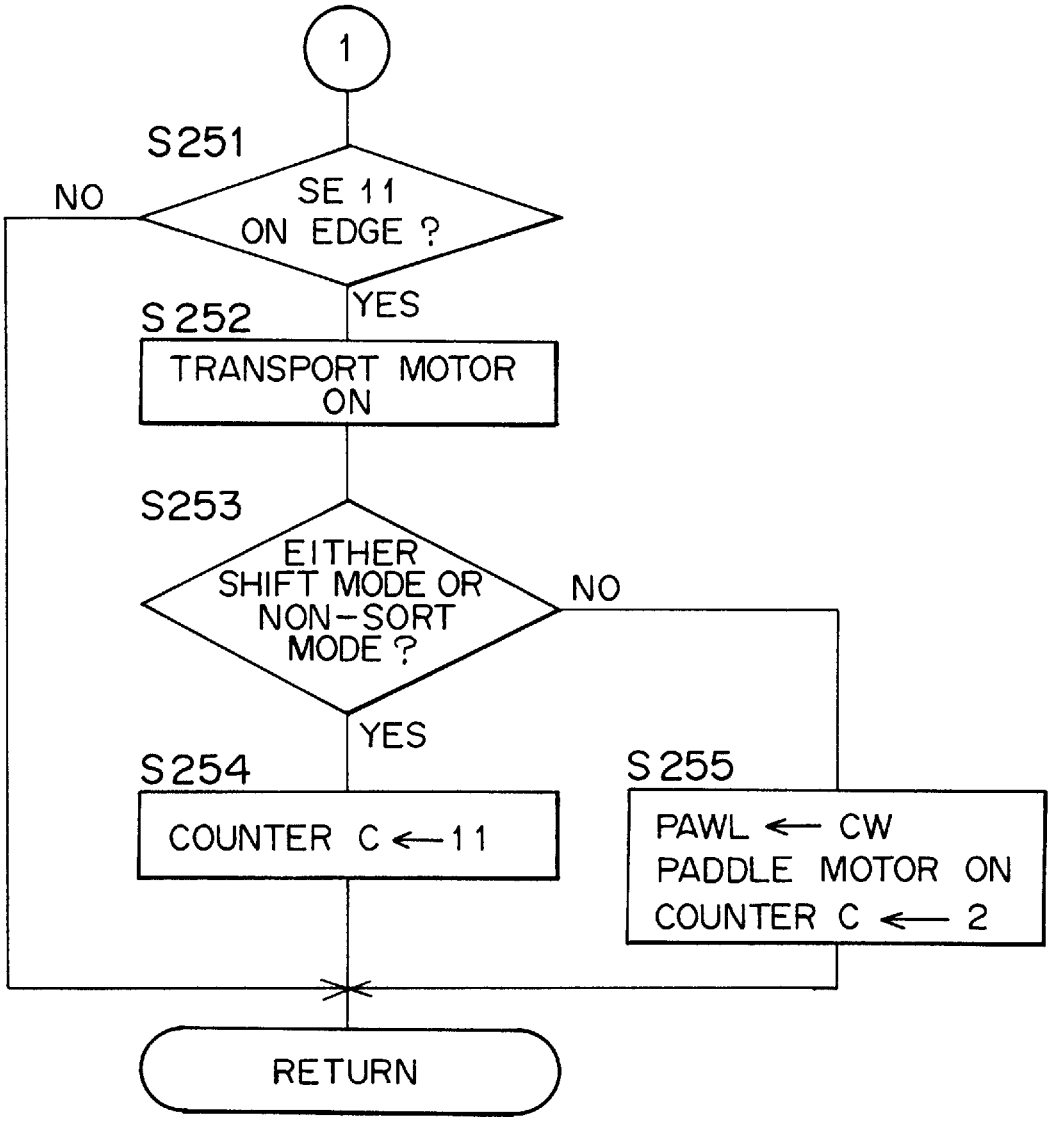
Figure 20C:
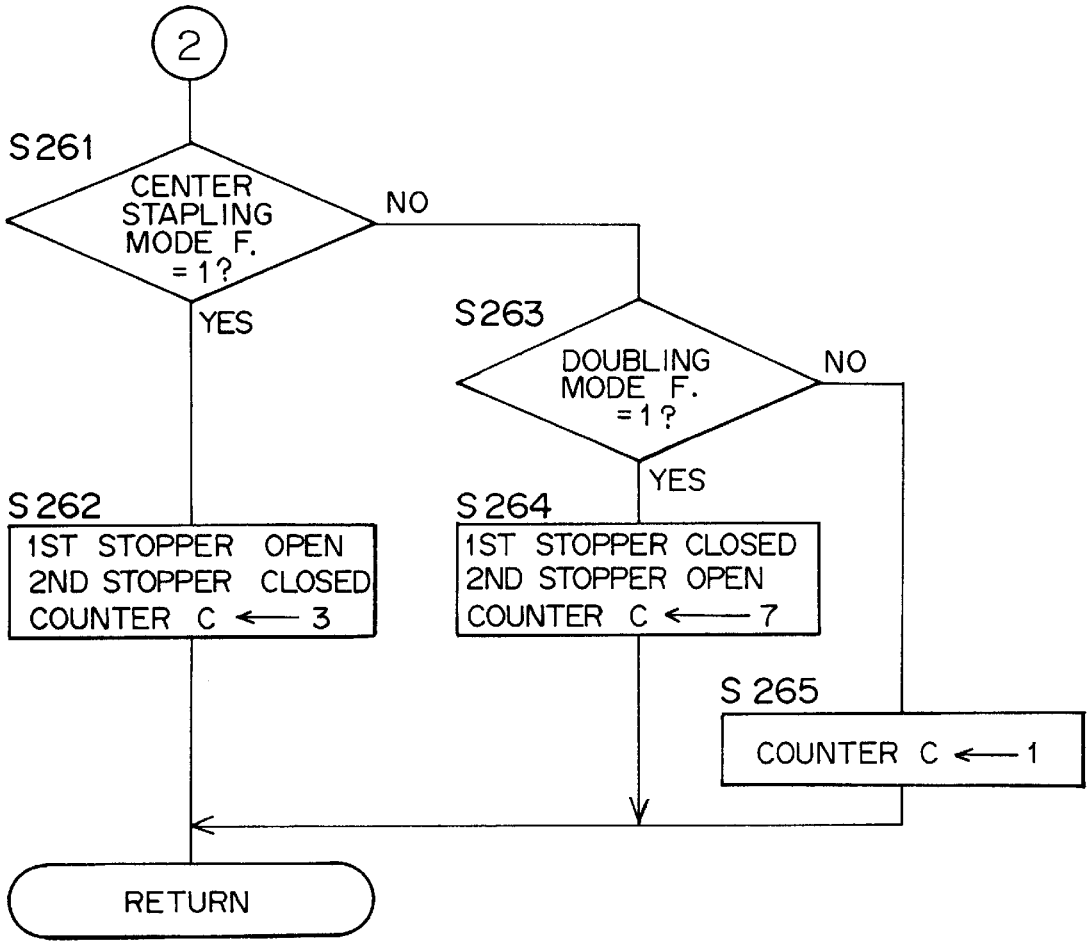
Figure 20D:
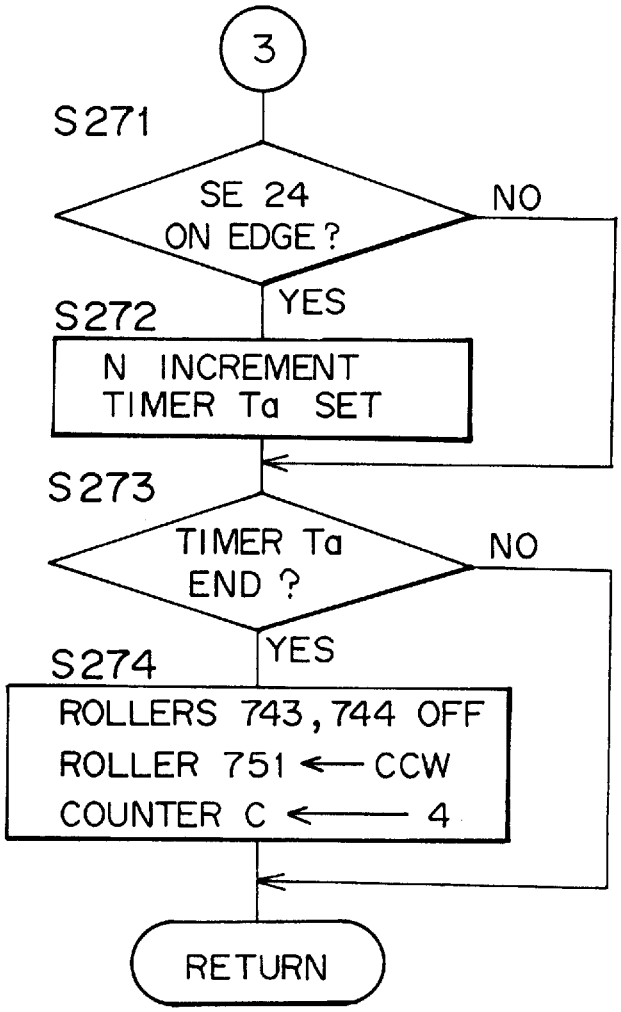
Figure 20E:
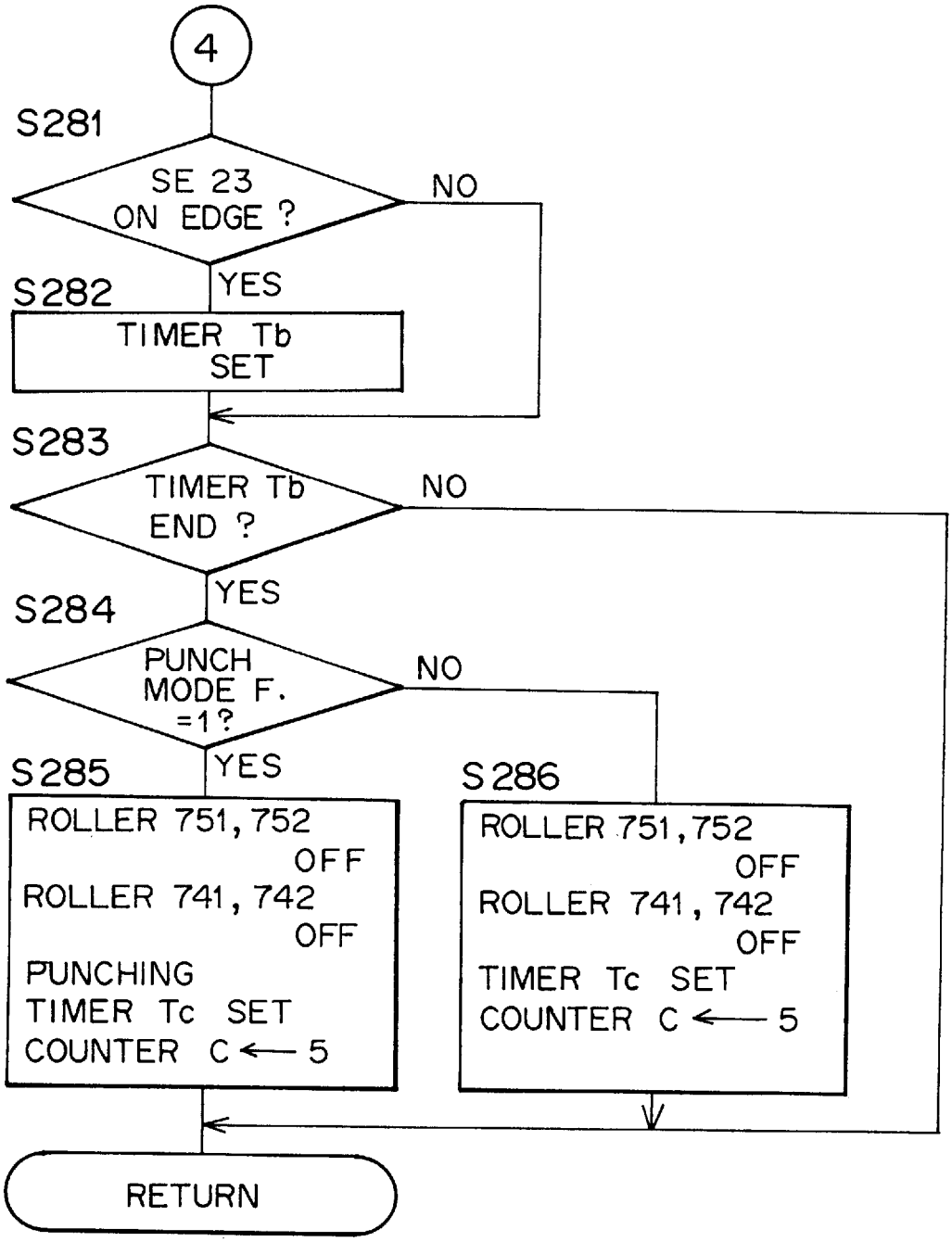
Figure 20F:
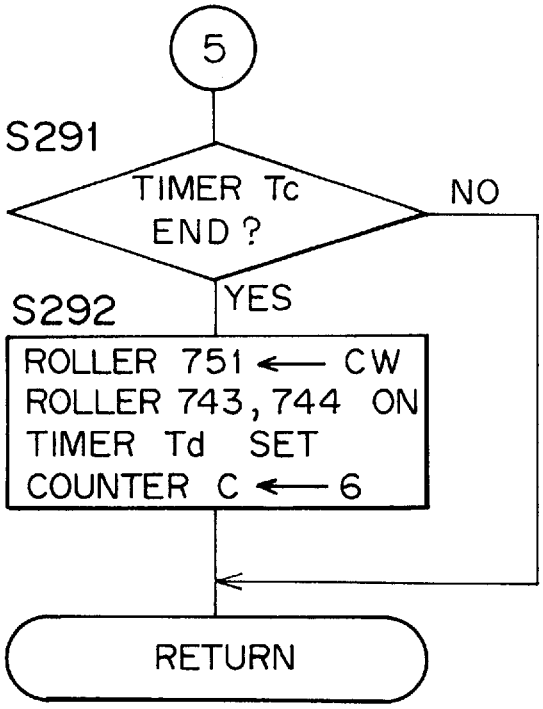
Figure 20G:
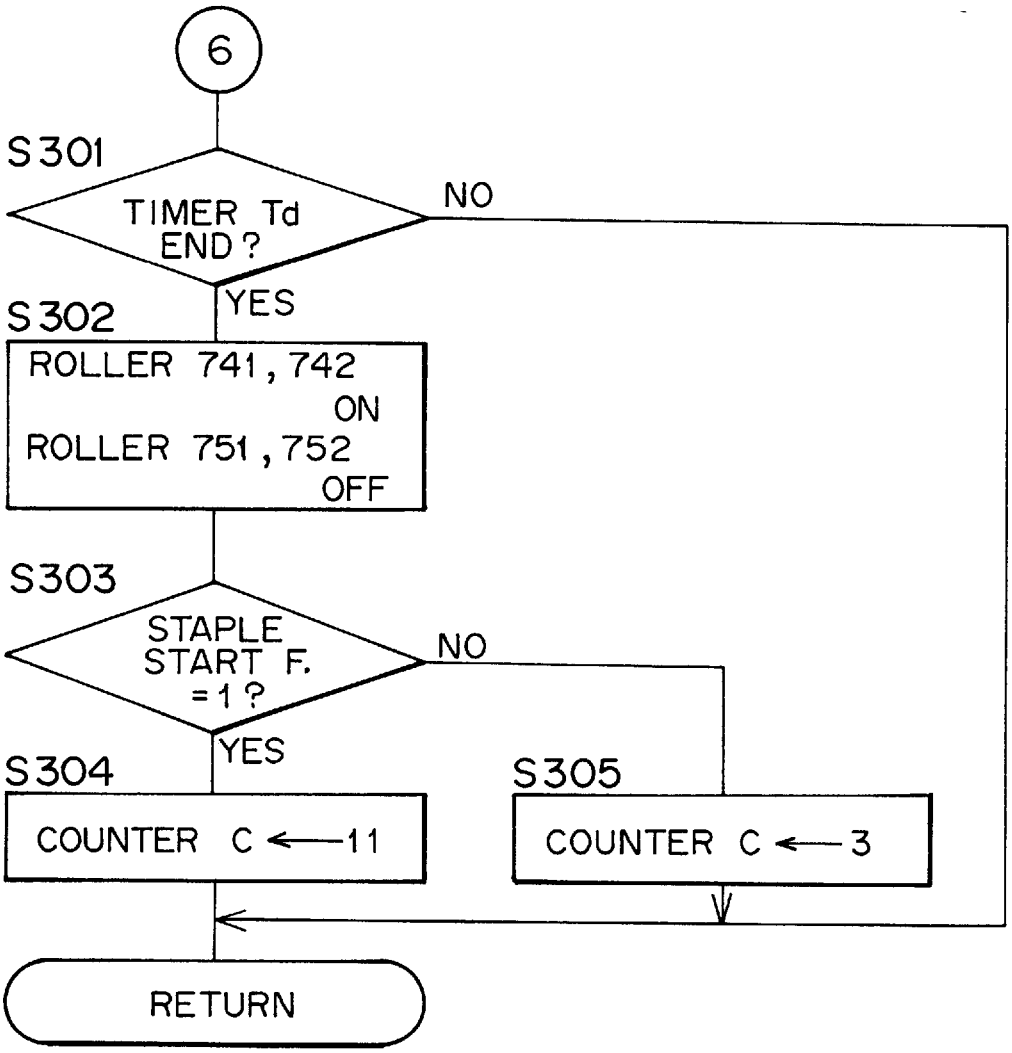
Figure 20H:
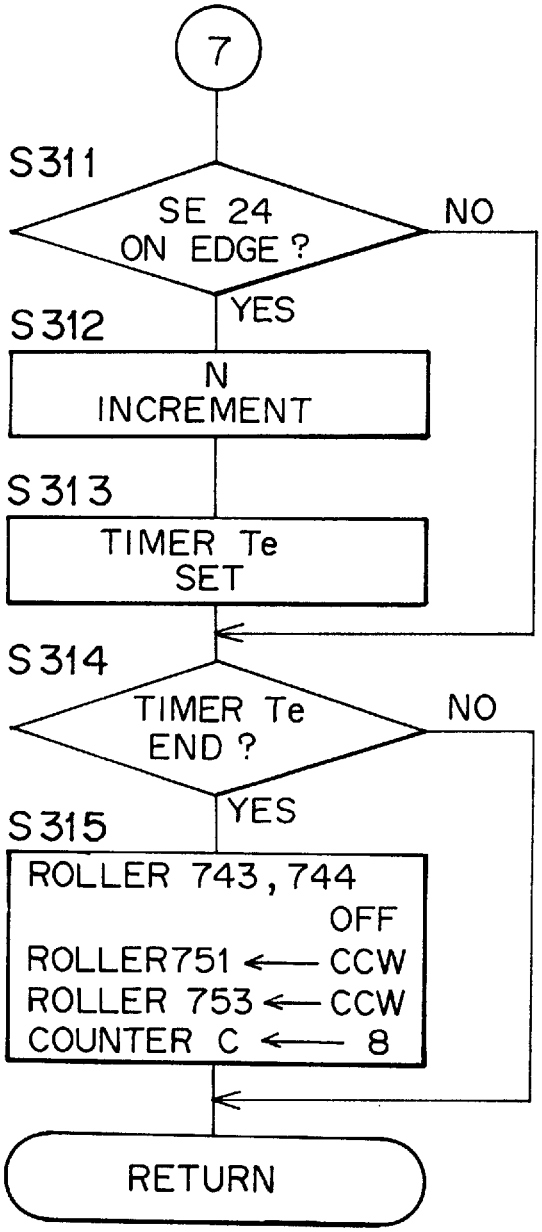
Figure 20I:
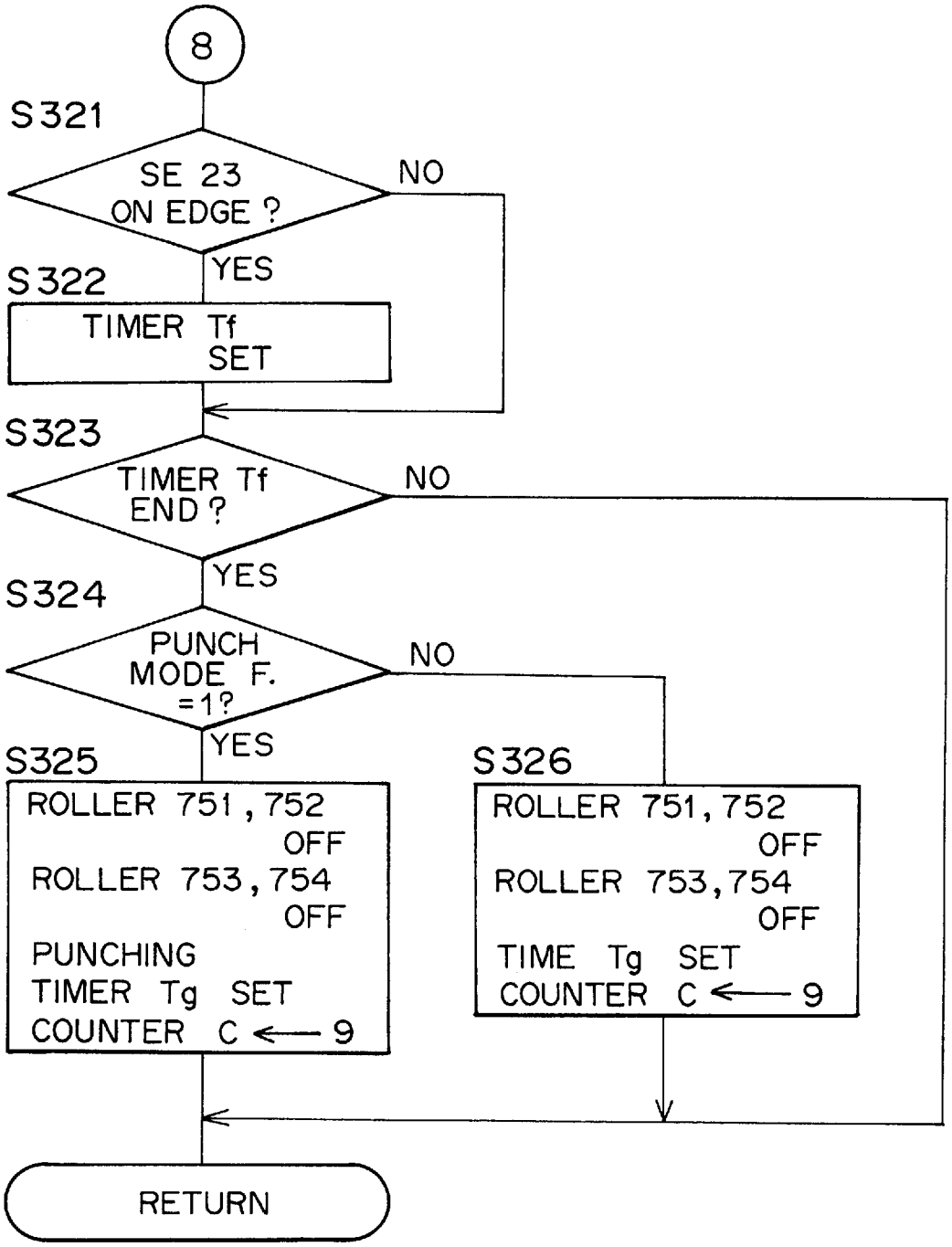
Figure 20J:
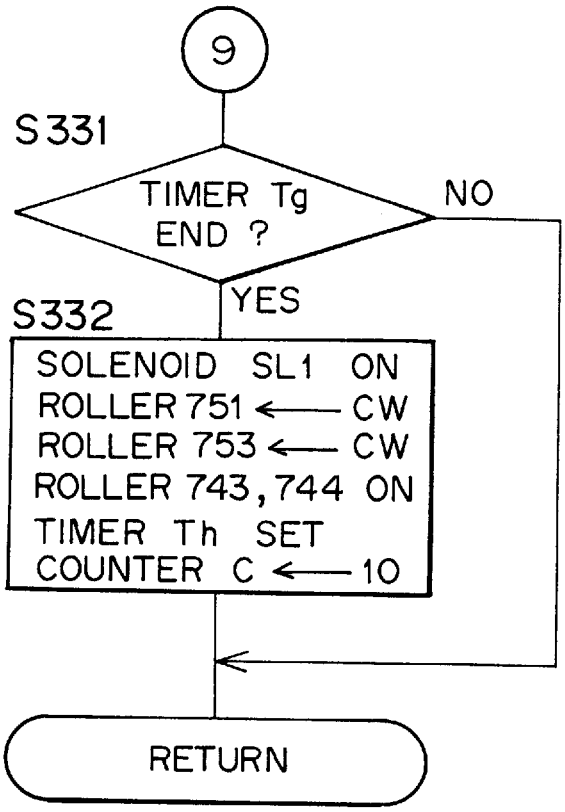
Figure 20K:
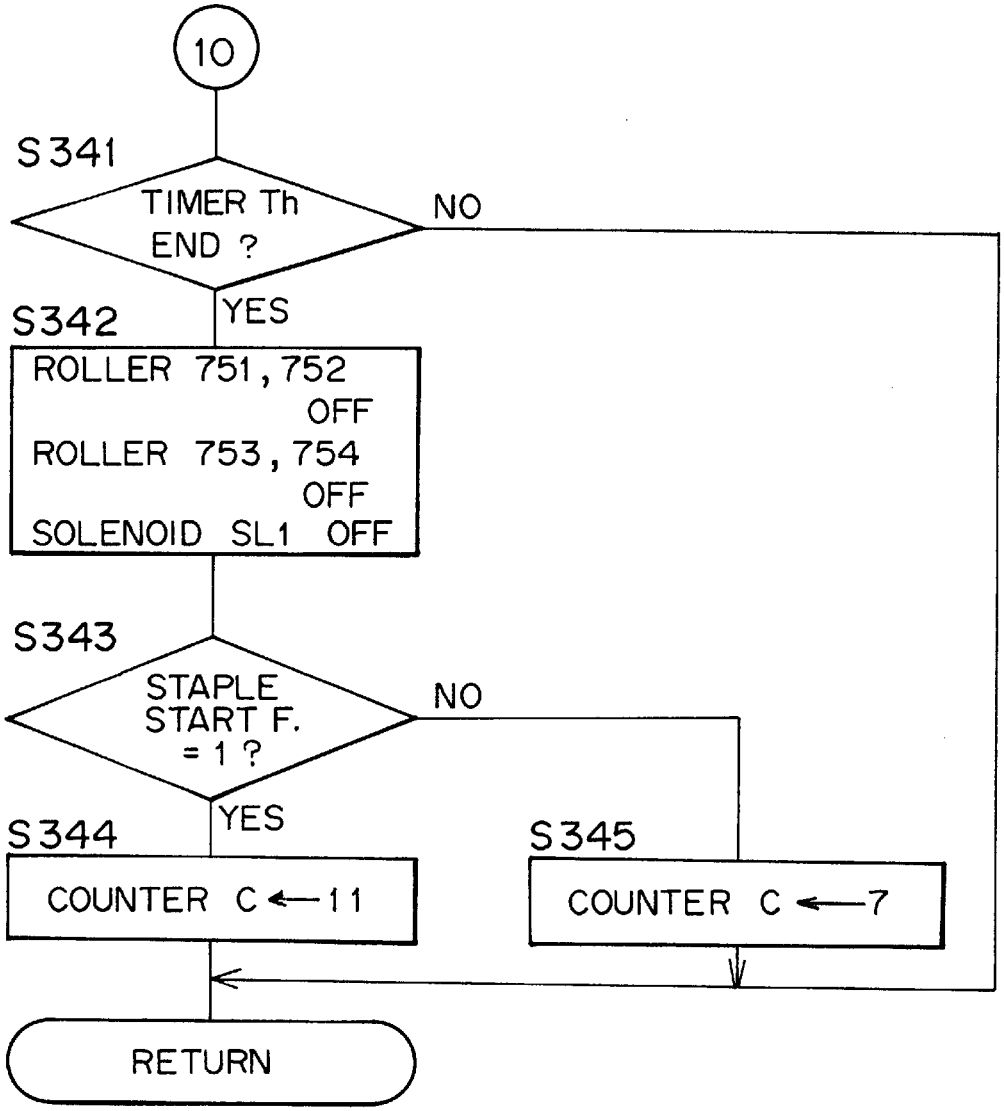
Figure 201:
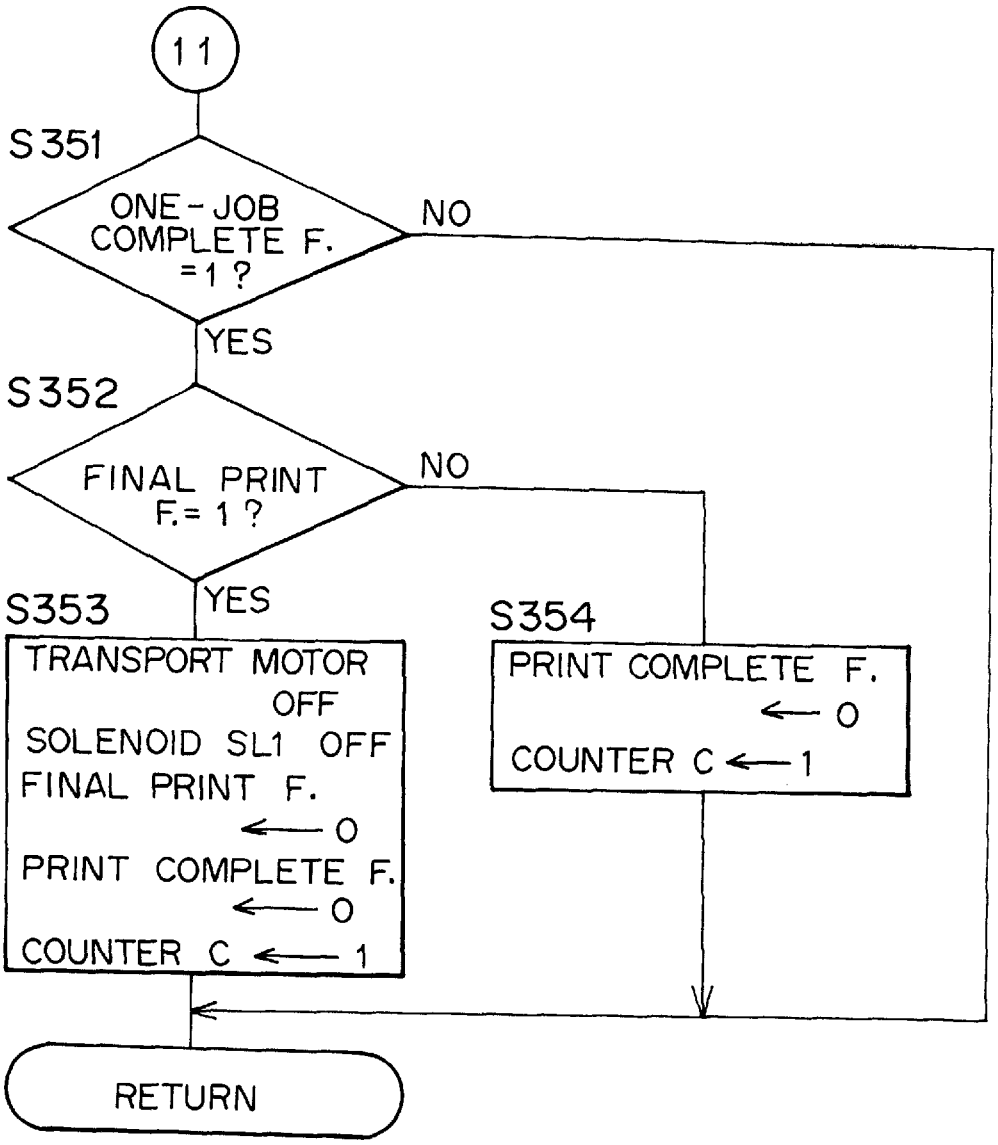
Figure 21A:
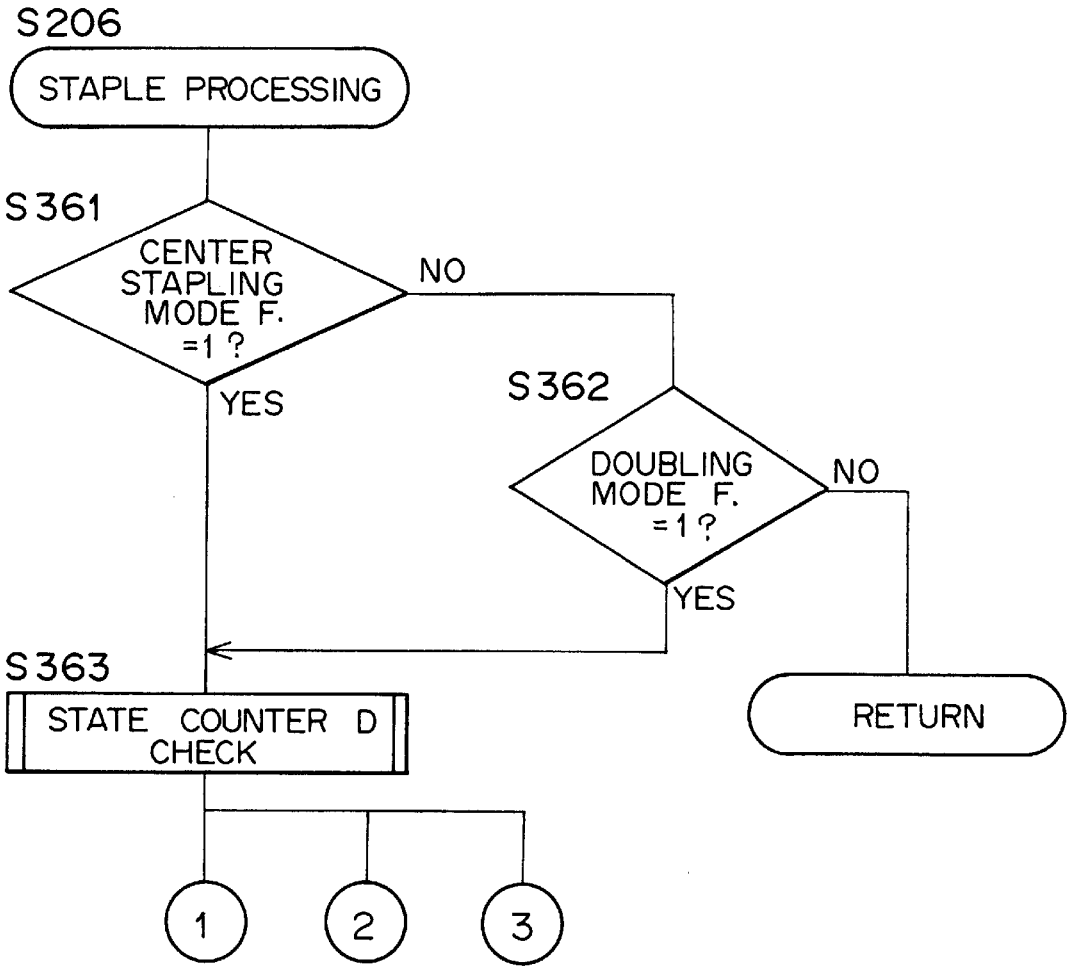
Figure 21B:
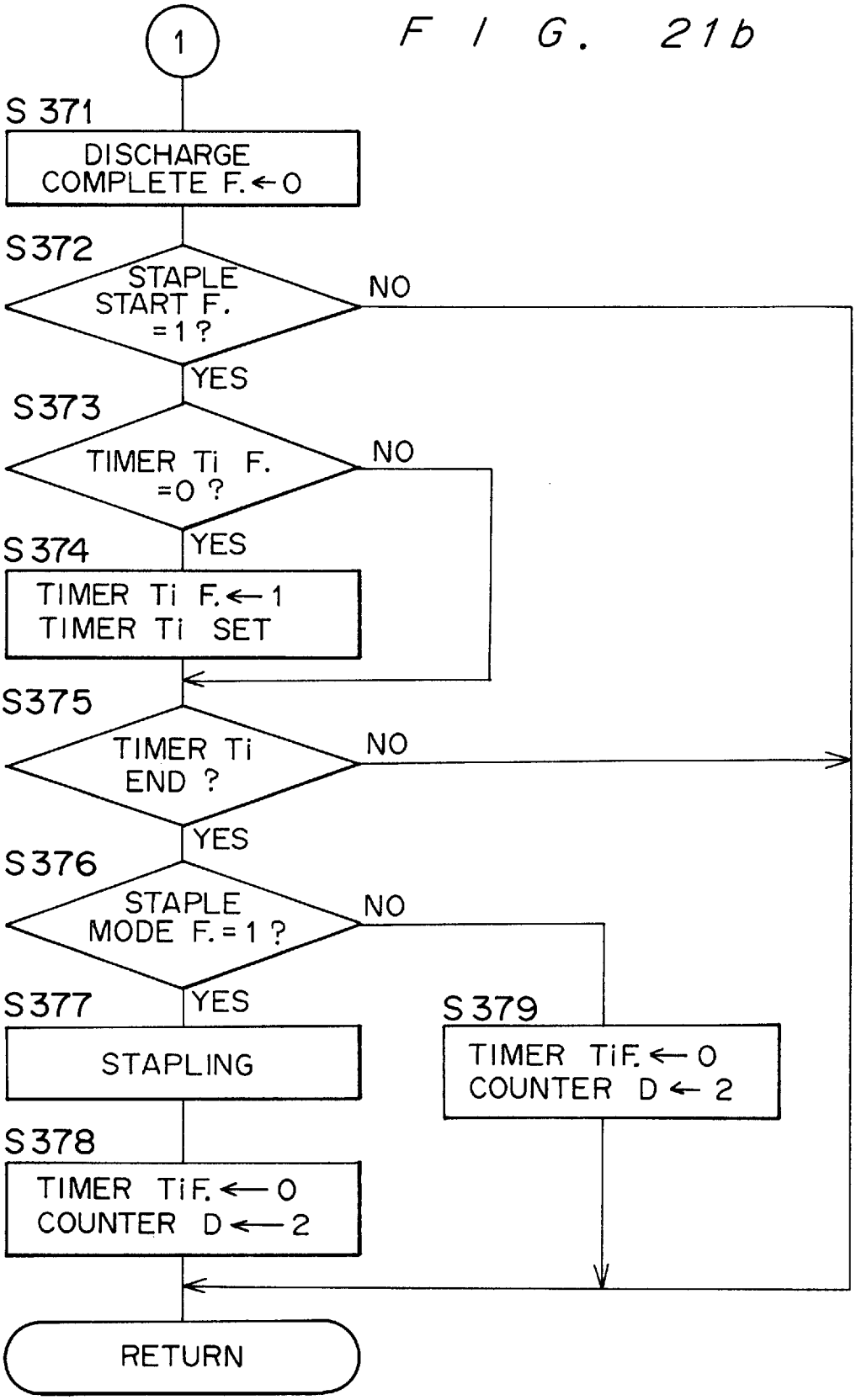
Figure 21C:
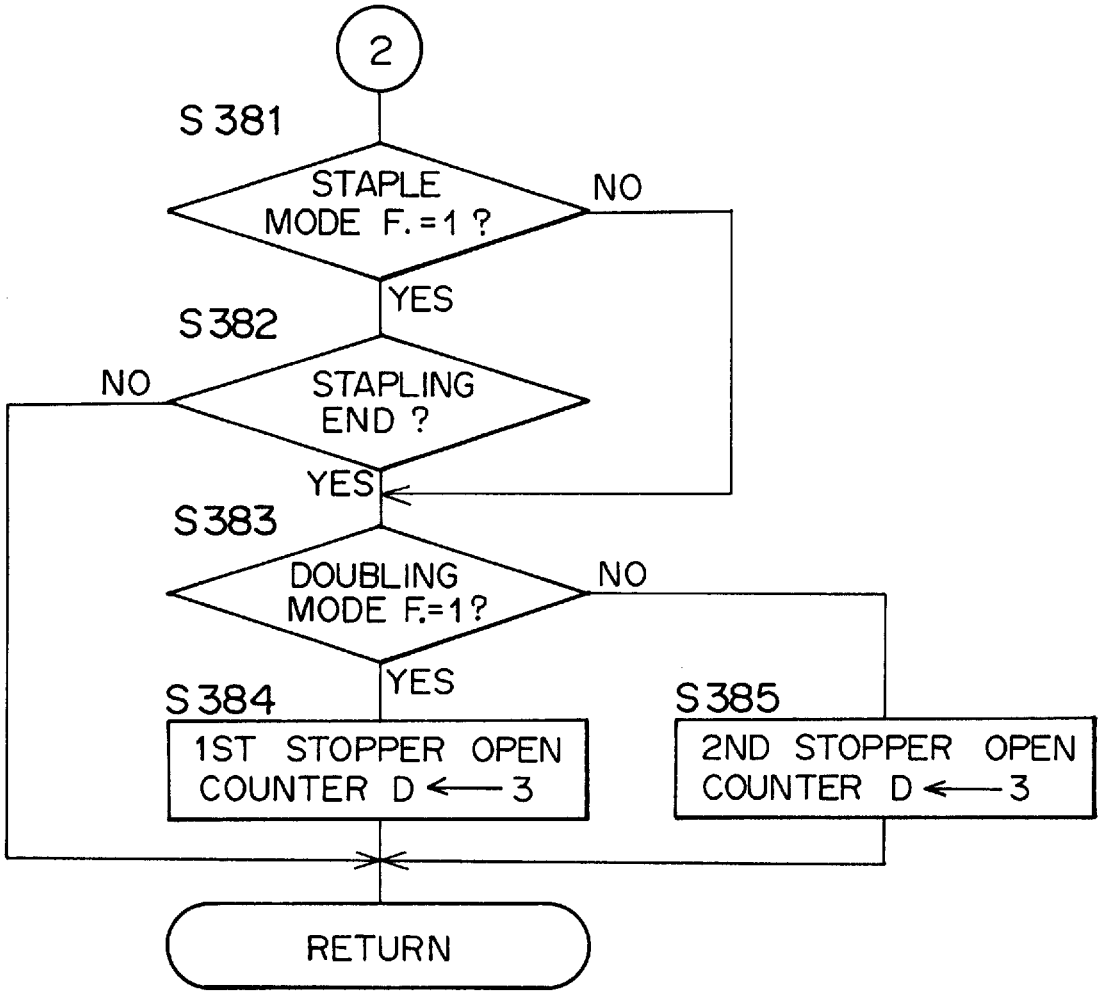

FIG. 19 shows a sub-routine for signal processing which is to be executed at step S219.

First, at step S221, it is determined whether the one-job complete flag is "1" or not. The one-job complete flag is set to "1" when a printing operation for one set ends in the copying machine 1, and a signal is transferred from the CPU 201 to the CPU 203 accordingly. If the one-job complete flag is set to "1", then at step S222, a one-job complete flag is set to "1". Then, at step S223, it is determined whether the one-job complete flag is "1" or not. If the flag is set to "1", then at step S224, it is determined whether or not the count of a counter N is equal to the number of print sets. If N=number of print sets, then at step S225, the staple start flag is set to "1".

Next, at step S226, it is determined whether the print complete flag is "1" or not. The print complete flag is set to "1" when printing of the number of print sets ends in the copying machine 1, whereupon a signal is transferred from the CPU 201 to the CPU 203. If the print complete flag is set to "1", then the print complete flag is set to "1" at step S227. Subsequently, at step S228 it is determined whether the print complete flag is "1" or not, and if the flag has been set to "1", then at step S229 a decision is made whether printing has ended or not. If "YES", then at step S230 a final print flag is set to "1".

FIGS. 20*a*–20*l* show a sub-routine for transport/punching/folding which is to be executed at step S204. In this sub-routine, it is first verified at step S241 that a printing operation is in progress, and then at step S242 the count of a state counter C is checked. Processing is carried out according to the count ("1"–"11"; initially set at "1") as described hereinbelow.

When the counter C is "1" (see FIG. 20*b*), at step S251, it is determined whether or not the sensor SE11 in the sheet inversion unit 600 is on edge. if the sensor SE11 is on edge, that is, if a sheet is being transported to the finisher unit 700, then at step S252 a transport motor is switched on, whereby the finisher unit 700 is ready for sheet transport. Next, at step S253, it is determined whether or not the processing mode is either the shift mode or the non-sort mode. If "YES", then at step S254 the counter C is set to "11", and each sheet is transported to the discharge tray 720. If the processing mode is neither the shift mode nor the non-sort mode, then at step S255 the changeover pawl 703 is pivoted in the clockwise direction to guide the sheet into the longitudinal transport path 740. At the same time, a paddle motor is driven to rotate the paddle 770, and the counter C is set to "2".

When the counter C is "2" (see FIG. 20*c*), at step S261, it is determined whether the center stapling mode flag is "1" or not, and at step S263 it is determined whether the doubling mode flag is "1" or not. If the center stapling mode flag is set at "1", then at step S262 the first stopper 765 is opened, and the second stopper 767 is closed. Thereby, the second stopper 767 is caused to be ready for regulating the lower edge of each sheet delivered onto the staple tray 760. At the same time, the counter C is set to "3". If the doubling mode flag is set at "1", then at step S264 the first stopper 765 is closed, and the second stopper 767 is opened. Thereby, the first stopper 765 is caused to be ready for regulating the lower edge of each sheet delivered onto the staple tray 760. At the same time, the counter C is set to "7". If both the center stapling mode flag and the doubling mode flag are reset to "0", the counter C is set to "1", at step S265.

When the counter C is "3" (see FIG. 20*d*), that is, when the center stapling mode is selected, at step S271 it is verified that the sensor SE24 is on edge, which means that the leading edge of a sheet is introduced into the longitudinal transport path 740, at step S272 the counter N is incremented, and time setting is made with a timer Ta. The timer Ta is set to a time to be taken after the leading edge of the sheet runs past the detection point of the sensor SE24 until it reaches the nip portion of the transport rollers 743, 744. At step S273, the count end of the timer Ta is verified; then at step S274, the transport rollers 743, 744 are switched off, and the sheet folding roller 751 is driven for counter-clockwise rotation. Further, the counter C is set to "4". As a result, the sheet goes in contact, at its leading edge, with the nip portion of the transport rollers 743, 744 which are in off-rotation condition, the sheet being thus bent at its center portion so that it is threaded between the sheet folding rollers 751, 752 (see FIG. 5*a*). It is noted that the folding roller 752 rotates following the folding roller 751.

When the counter C is "4" (see FIG. 20*e*), at step S281, it is verified that the sensor SE23 is on edge. Then, at step S282, time setting is made with a timer Tb. The timer Tb is set to a time to be taken after the leading edge of the sheet fold runs past the detection point of the sensor SE23 until it reaches a punching position (see FIG. 5*b*) in the center stitch mode. At step S283, the count end of the timer Tb is verified; then at step S284 it is determined whether the punch mode flag is "1" or not. If the punch mode flag is set at "1", then at step S285 the sheet folding rollers 751, 752 and the transport rollers 741, 742 are switched off, and the punching rod 757 is driven to form a punch hole near the fold line of the sheet. At the same time, time setting is made with a timer Tc, and the counter C is set to "5". The timer Te is set to time required for the punching operation.

On the other hand, if the punch mode flag is reset to "0" (i.e., "NO" at step S284), then at step S286 the sheet folding rollers 751, 752 and the transport rollers 741, 742 are switched off. At the same time, time setting is made with a timer Tc, and the counter C is set to "5". In this case, only a center fold is formed on the sheet, and no punch hole is formed.

When the counter C is "5" (see FIG. 20*f*), the count end of the timer Tc is verified at step S291. Then, at step S292, the sheet folding roller 751 is driven for rotation in the clockwise direction, and the transport rollers 743, 744 are rotated. As a result, the sheet is transported downward, while being gradually unfolded, along the longitudinal transport path 740 (see FIGS. 5*c*, 5*d*). At the same time, time setting is made with a timer Td, and counter C is set to "6". The timer Td is set to a time required until the centrally folded sheet is unfolded.

When the counter C is "6" (see FIG. 20*g*), the count end of the timer Td is verified at step S301. Then, at step S302, the transport rolLers 741, 742 are driven into rotation again for transport of a next sheet, and the sheet folding rollers 751, 752 are stopped. Then, at step S303, it is determined whether the staple start flag is "1" or not. If the flag is set to "1", then at step S304, the counter C is set to "11". If the staple start flag is reset to "0", then at step S305, the counter C is set to "3" in preparation for transport of a next sheet.

when the counter C is "7" (see FIG. 20*h*), that is when the doubling mode is selected, at step S311 it is verified that the sensor SE24 is on edge. Then at step S312, the counter N is incremented, and at step S313, time setting is made with a timer Te. The time set in the timer Te is equal to that of the timer Ta. At step S314, the count end of the timer Te is verified; then at step S315 the transport rollers 743, 744 are switched off, and the sheet folding roller 751 and the transport roller 753 are driven for counter-clockwise rotation. Further, the counter C is set to "8". As a result, the sheet goes in contact, at its leading edge, with the nip portion of the transport rollers 743, 744 which are in off-rotation condition, the sheet being thus bent at its center portion so that it is threaded between the sheet folding rollers 751, 752 (see FIG. 6*a*).

When the counter C is "8" (see FIG. 20*i*), at step S321, it is verified that the sensor SE23 is on edge. Then, at step S322, time setting is made with a timer Tf. The timer Tf is set to a time to be taken after the leading edge of the sheet fold runs past the detection point of the sensor SE23 until it reaches a punching position (see FIG. 6*b*) in the doubling mode. At step S323, the count end of the timer Tf is verified; then at step S324 it is determined whether the punch mode flag is set to "1" or not. If the punch mode flag is set at "1", then at step S325 the sheet folding rollers 751, 752 and the transport rollers 753, 754 are switched off, and the punching rod 757 is driven to form a punch hole at a position opposite to the fold line of the sheet. At the same time, time setting is made with a timer Tg, and the counter C is set to "9". The timer Tg is set to a time required for the punching operation as is the case with the timer Tc.

On the other hand, if the punch mode flag is reset to "0" ("NO" at step S324), then at step S326 the sheet folding rollers 751, 752 and the transport rollers 753, 754 are switched off. At the same time, time setting is made with a timer Tg, and the counter C is set to "9". In this case, the sheet is only doubled or folded in two, and no punch hole is formed.

When the counter C is "9" (see FIG. 20*j*), the count end of the timer Tg is verified at step S331, and then at step S332 the solenoid SL1 is turned on to cause the changeover pawl 755 to advance into the longitudinal transport path 740, and at the same time, the sheet folding roller 751 and the transport roller 753 are driven for clockwise rotation. The transport rollers 743, 744 are also driven for rotation. Thus, the sheet, as folded in two, is transported downward along the longitudinal transport path 740 (see FIGS. 6*c* and 6*d*). At the same time, a timer Th is set on, and the counter C is set to "10". The timer Th is set to the time required for the two-fold sheet to pass through the sheet folding rollers 751, 752.

When the counter C is "10" (see FIG. 20*k*), the count end of the timer Th is verified at step S341. Then at step S342 the sheet folding rollers 751, 752 and the transport rollers 753, 754 are turned off, and at the same time, the solenoid SL1 is turned off. As a result, the changeover pawl 755 shunts from the longitudinal transport path 740. Next, at step S343, it is determined whether the staple start flag is "1" or not. If the flag has been set to "1", then at step S344 the counter C is set to "11". If the flag has been reset to "0", then at step S345 the counter C is set to "7" to prepare for transport of a next sheet.

When the counter C is "11" (see FIG. 20*l*), at step S351, it is determined whether the one-job complete flag (see step S222 in FIG. 19) is "1" or not. If the flag has been reset to "0", the program returns to the main routine. If the flag is set to "1", then at step S352 it is determined whether the final print flag (see step S230 in FIG. 19) is "1" or not. If it has been set to "1", there is no further sheet transport and, therefore, at step S353 the finisher unit 700 is returned to its initialized state. Specifically, the transport motor and the solenoid SL1 are turned off; the final print flag and print complete flag are reset to "0"; and the counter C is reset to "1". If the final print flag is already reset to "0", then at step S354, in preparation for sheet transport in a next job, the print complete flag is reset to "0", and the counter C is reset to "1".

FIGS. 21*a*–21*d* show a sub-routine for a stapling operation which is to be executed at step S206. In this sub-routine, at step S361 or step S362, it is verified that the center stapling mode flag or the doubling mode flag is set to "1". Then, at step S363, the count of a state counter D is checked and, according to the count ("1"–"3"; initially set to "1"), processing is carried out as described hereinbelow.

When the counter D is "1" (see FIG. 21*a*), at step S371, a discharge complete flag (see step S394 in FIG. 21*d*) is reset to "0", and at step S372 it is determined whether the staple start flag is "1" or not. If the flag is already set to "1" (see step S225 in FIG. 19), then at step S373, it is verified that a timer Ti flag has been reset to "0". Then, at step S374, the timer Ti flag is set to "1", and a timer Ti is set. The timer Ti is set to a time required until the final sheet for one job is received onto the staple tray 760.

Next, if, at step S375, the count end of the timer Ti is verified, then at step S376 it is determined whether the staple mode flag is "1" or not. If the flag is already set to "1", then at step S377 the stapler 771 is actuated. Then, at step S378, the timer Ti flag is reset to "0", and the counter D is set to "2".

On the other hand, if the staple mode flag is already reset to "0" ("NO" at step S376), then at step S379, the timer Ti flag is reset to "0", and the counter D is set to "2".

When the counter D is "2" (see FIG. 21*c*), at step S381 it is verified that the staple mode flag has been set to "1". Then, at step S382, a decision is made whether a stapling operation has ended or not. If the stapling operation has ended, then at step S383 it is determined whether the doubling mode flag is "1" or not. If the flag has been set to "1", then at step S384 the first stopper 765 is released, and the counter D is set to "3". Thus, a double-edge-stitched sheet set is discharged onto the stacker 780. if the doubling mode flag has been reset to "0", the current mode is the center stitch mode, and therefore, at step S385, the second stopper 767 is released, and the counter D is set to "3". As a result, a center-stitched sheet set is discharged onto the stacker 780.

When the counter D is "3" (see FIG. 21*d*), if it is verified at step S391 that the sensor SE26 is off edge, that is, if the trailing edge of a stapled sheet set is detected by the sensor SE26, then at step S392 time setting is made with a timer Tj. The timer Tj is set to a time in which the sheet set is reliably discharged onto the stacker 780. If, at step S393, the count end of the timer Tj is verified, then at step S394 the counter N is reset, the staple start flag is reset to "0", and the discharge complete flag is set to "1". Also, the counter D is reset to "1".

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming system which comprises an image forming apparatus and a finisher for processing a sheet on which an image is formed in the image forming apparatus, wherein:

the image forming apparatus comprises:

a mode setting means for setting either a first mode or a second mode; and an image forming means for forming an image on a sheet and delivering the sheet to the finisher; and the finisher comprises:

a folding means for receiving the sheet from the image forming means and folding the sheet in two; and a transporting means for transporting the sheet after being folded by the folding means to a next process section, the transporting means, when the first mode is set, transporting the sheet to the next process section with the sheet unfolded, and when the second mode is set, transporting the sheet to the next process with the sheet folded.

2. An image forming system as claimed in claim 1, wherein the image forming means forms images of a plural number of pages on a plurality of sheets in an order according to the first or second mode.

3. An image forming system as claimed in claim 2, wherein the image forming means comprises a memory for storing image data of the plural number of pages and reads out the image data from the memory to form images on the plurality of sheets in the order according to the first or second mode.

4. The image forming system of claim 1, wherein the finisher further comprises a sheet path through which the sheet travels during folding and transporting, and the sheet travels through the same sheet path when either the first mode or the second mode is set.

5. An image forming system which comprises an image forming apparatus and a finisher for processing a sheet on which an image is formed in the image forming apparatus, wherein:

the image forming apparatus comprises:

a mode setting means for setting either a first mode or a second mode; and an image forming means for forming an image on a sheet and delivering the sheet to the finisher; and the finisher comprises:

a folding means for receiving the sheet from the image forming means, wherein the folding means, when the first mode is set, folds the sheet in two with a first side inside, and when the second mode is set, folds the sheet in two with the first side outside; and a transporting means for transporting the sheet folded by the folding means to a next process section, the transporting means, when the first mode is set, transporting the sheet to the next process section with the sheet unfolded, and when the second mode is set, transporting the sheet to the next process with the sheet folded.

6. An image forming system as claimed in claim 5, further comprising:

a sheet inverting means for inverting a sheet;

wherein the sheet inverting means, when the first mode is set, inverts the sheet and then delivers the sheet to the folding means, and when the second mode is set, delivers the sheet to the folding means without inverting the sheet.

7. An image forming system which comprises an image forming apparatus and a finisher for processing a sheet on which an image is formed in the image forming apparatus, wherein:

the image forming apparatus comprises:

a mode setting means for setting either a first mode or a second mode; and an image forming means for forming an image on a sheet and delivering the sheet to the finisher; and the finisher comprises:

a folding means for receiving the sheet from the image forming means and folding the sheet in two;

a transporting means for transporting the sheet folded by the folding means to a next process section, the transporting means, when the first mode is set, transporting the sheet to the next process section with the sheet unfolded, and when the second mode is set, transporting the sheet to the next process with the sheet folded; and a punching means for making a punch hole in the sheet; and, wherein the punching means, when the first mode is set, makes a punch hole in the sheet near a folding position formed by the folding means, and when the second mode is set, makes a punch hole in the sheet near an edge opposite to the folding position.

8. An image forming system which comprises an image forming apparatus and a finisher for processing a sheet on which an image is formed in the image forming apparatus, wherein:

the image forming apparatus comprises:

a mode setting means for setting either a first mode or a second mode; and an image forming means for forming an image on a sheet and delivering the sheet to the finisher; and the finisher comprises:

a folding means for receiving the sheet from the image forming means and folding the sheet in two;

a transporting means for transporting the sheet folded by the folding means to a next process section, the transporting means, when the first mode is set, transporting the sheet to the next process section with the sheet unfolded, and when the second mode is set, transporting the sheet to the next process with the sheet folded; and a stapling means for stapling a plurality of sheets; and, wherein the stapling means, when the first mode is set, staples the plurality of sheets near a folding position of each sheet formed by the folding means, and when the second mode is set, staples the plurality of sheets near an edge of each sheet opposite to the folding position.

9. An image forming system which comprises an image forming apparatus and a finisher for processing a sheet on which an image is formed in the image forming apparatus, wherein:

the image forming apparatus comprises:

a mode setting means for setting either a first mode or a second mode; and an image forming means for forming an image on a sheet and delivering the sheet to the finisher; and the finisher comprises:

a folding means for receiving the sheet from the image forming means and folding the sheet in two;

a transporting means for transporting the sheet folded by the folding means to a next process section, the transporting means, when the first mode is set, transporting the sheet to the next process section with the sheet unfolded, and when the second mode is set, transporting the sheet to the next process with the sheet folded; and the image forming means is operative in a simplex mode whereby an image is formed on only a first side of the sheet and in a duplex mode whereby images are formed on the first side and a second side of the sheet; and the image forming system further comprises a control means for inhibiting an operation in the first mode when the image forming means operates in the simplex mode.

10. An image forming system as claimed in claim 9, wherein the control means, when the first mode and the simplex mode are concurrently set, cancels the first mode and sets the second mode.

11. A finisher comprising:

a folding means for receiving a sheet and folding the sheet in two; and a transporting means for transporting the sheet after being folded by the folding means to a next process section, the transporting means, when a first mode is set, transporting the sheet to the next process section with the sheet unfolded, and when a second mode is set, transporting the sheet to the next process with the sheet folded.

12. The finisher of claim 11, further comprising a sheet path through which a sheet travels during folding and transporting, and the sheet travels through the same sheet path when either the first mode or the second mode is set.

13. A finisher comprising:

a folding means for receiving a sheet and folding the sheet in two;

a transporting means for transporting the sheet folded by the folding means to a next process section, the transporting means, when the first mode is set, transporting the sheet to the next process section with the sheet unfolded, and when the second mode is set, transporting the sheet to the next process with the sheet folded; and a punching means for making a punch hole in the sheet, wherein the punching means, in the first mode, makes a punch hole in the sheet near a folding position formed by the folding means, and in the second mode, makes a punch hole in the sheet near an edge opposite to the folding position.

14. A finisher comprising:

a folding means for receiving a sheet and folding the sheet in two; and a transporting means for transporting the sheet folded by the folding means to a next process section, the transporting means, when the first mode is set, transporting the sheet to the next process section with the sheet unfolded, and when the second mode is set, transporting the sheet to the next process with the sheet folded; and a stapling means for stapling a plurality of sheets, wherein the stapling means, in the first mode, staples the plurality of sheets near a folding position of each sheet formed by the folding means, and in the second mode, staples the plurality of sheets near an edge of each sheet opposite to the folding position.

15. A finisher comprising:

a first transporting means for transporting a sheet;

a folding means for receiving the sheet transported by the first transporting means and folding the sheet in two, the folding means having a second transporting means which transports the folded sheet with a folding position as a leading edge; and a punching means for making a punch hole in the sheet folded by the folding means at either the leading edge of the sheet or an edge opposite to the leading edge of the sheet depending on a selected mode of operation, the punching means being disposed adjacent to the second transporting means.

16. A finisher as claimed in claim 15, wherein the punching means operates while the sheet is held by the second transporting means.

17. A finisher comprising:

a first transporting means for transporting a sheet;

a folding means for receiving the sheet transported by the first transporting means and folding the sheet in two, the folding means having a second transporting means which transports the folded sheet with a folding position as a leading edge; and a punching means for making a punch hole in the sheet folded by the folding means, the punching means being disposed adjacent to the second transporting means, and being capable of punching either end of the sheet; wherein the second transporting means has a pair of roller members which nip a center portion of the sheet transported by the first transporting means to fold the sheet; and the sheet is transported with the folding position as a leading edge by forward rotation of the roller members and with the folding position as a trailing edge by reverse rotation of the rolling members.

18. A finisher as claimed in claim 17, wherein the sheet folded by the folding means is transported back to the first transporting means with the folding position as a trailing edge by reverse rotation of the roller members and continuously transported by the first transporting means.

19. An image forming system comprising:

an image forming means which repeats an image forming cycle a plural number of times to make a plural number of print sets;

a finisher which receives a print set made by the image forming means and provides finishing processing to the print set;

a first setting means for setting a number of times for the image forming means to repeat the image forming cycle;

a second setting means for setting a number of print sets to be subjected to the finishing processing independently of the number of times set by the first setting means; and a control means for commanding the image forming means to repeat the image forming cycle the number of times set by the first setting means to obtain the number of print sets and for commanding the finisher to perform the finishing processing on the number of print sets set by the second setting means.

20. An image forming system as claimed in claim 19, wherein the finisher makes a punch hole in each print set.

21. An image forming system as claimed in claim 19, wherein the finisher staples each print set.

22. An image forming system as claimed in claim 19, further comprising a changing means which, when the number of print sets set by the second setting means is larger than the number of times for repeating the image forming cycle set by the first setting means, changes the number of times for repeating the image forming cycle set by the first setting means to equal the number of print sets set by the second setting means.

23. An image forming system comprising:

an image forming means which repeats an image forming cycle a plural number of times to make a plural number of print sets, each print set containing a plurality of sheets;

a finisher which receives a print set made by the image forming means and provides first finishing processing and second finishing processing to the print set;

a first setting means for setting a number of times for the image forming means to repeat the image forming cycle;

a second setting means for setting a number of print sets to be subjected to the second finishing processing independently of the number of times set by the first setting means;

an image forming control means for commanding the image forming means to repeat the image forming cycle the number of times set by the first setting means to obtain the number of print sets set by the second setting means; and a finishing control means for commanding the finisher to perform the first finishing processing on the number of print sets set by the second setting means and to perform the second finishing processing on the number of print sets set by the second setting means.

24. An image forming system as claimed in claim 23, wherein the finisher folds each sheet of a print set as the first finishing processing and makes a punch hole in each sheet of a print set as the second finishing processing.

25. An image forming system as claimed in claim 23, wherein the finisher folds each sheet of a print set as the first finishing processing and staples each print set as the second finishing processing.

26. An image forming system as claimed in claim 23, further comprising a changing means which, when the number of print sets set by the second setting means is larger than the number of times for repeating the image forming cycle set by the first setting means, changes the number of times for repeating the image forming cycle set by the first setting means to equal the number of print sets set by the second setting means.

27. An image forming system comprising:

an image forming means which repeats a job for image formation of a plural number of sheets to make a plural number of print sets;

a finisher which receives a print set made by the image forming means and performs finishing processing on the print set;

an input means for setting or canceling the finishing processing; and a control means for, when the input means sets or cancels the finishing processing during a job of the image forming means, commanding the finisher to perform or cancel the finishing processing of a plural number of print sets made by succeeding jobs.

28. An image forming system as claimed in claim 27, wherein the finisher makes a punch hole in each sheet of each print set as the finishing processing.

29. An image forming system as claimed in claim 27, wherein the finisher staples each print set as the finishing processing.

* * * * *